US007641500B2

(12) United States Patent
Stoner et al.

(10) Patent No.: US 7,641,500 B2
(45) Date of Patent: Jan. 5, 2010

(54) POWER CABLE CONNECTOR SYSTEM

(75) Inventors: Stuart C. Stoner, Lewisberry, PA (US); Christopher J. Kolivoski, Lewisberry, PA (US)

(73) Assignee: FCI Americas Technology, Inc., Carson City, NV (US)

( * ) Notice: Subject to any disclaimer, the term of this patent is extended or adjusted under 35 U.S.C. 154(b) by 0 days.

(21) Appl. No.: 12/054,023

(22) Filed: Mar. 24, 2008

(65) Prior Publication Data

US 2008/0248680 A1 Oct. 9, 2008

Related U.S. Application Data

(60) Provisional application No. 60/910,178, filed on Apr. 4, 2007.

(51) Int. Cl.
*H01R 13/627* (2006.01)

(52) U.S. Cl. ..... 439/357; 439/449

(58) Field of Classification Search ..... 439/350–352, 439/355, 357, 358, 79, 449
See application file for complete search history.

(56) References Cited

U.S. PATENT DOCUMENTS

| | | | | |
|---|---|---|---|---|
| 318,186 | A | 5/1885 | Hertzog | |
| 741,052 | A | 10/1903 | Mahon | |
| 1,477,527 | A | 12/1923 | Raettig | |
| 2,248,675 | A | 7/1941 | Huppert | |
| 2,430,011 | A | 11/1947 | Gillentine | 173/361 |
| 2,759,163 | A | 8/1956 | Ustin et al. | |
| 2,762,022 | A | 9/1956 | Benander et al. | |
| 2,844,644 | A | 7/1958 | Soule, Jr. | |
| 3,011,143 | A | 11/1961 | Dean | |
| 3,178,669 | A | 4/1965 | Roberts | |
| 3,208,030 | A | 9/1965 | Evans et al. | |
| 3,286,220 | A | 11/1966 | Marley et al. | 439/680 |

(Continued)

FOREIGN PATENT DOCUMENTS

| | | |
|---|---|---|
| DE | 1 665 181 | 4/1974 |

(Continued)

OTHER PUBLICATIONS

Finan, J.M., "Thermally Conductive Thermoplastics", LNP Engineering Plastics, Inc., Plastics Engineering 2000, www.4spe.org, 4 pages.

(Continued)

*Primary Examiner*—Javaid Nasri
(74) *Attorney, Agent, or Firm*—Woodcock Washburn LLP

(57) ABSTRACT

This invention relates to an improved power connector that has a housing comprising a plurality of slots that are each for receiving a receptacle contact. Preferably, the housing has a plurality of quick-disconnect contacts each disposed in one of the housing slots. Further, a cover, may be coupled to the housing, and the housing may comprise a top portion and a bottom portion. A strain relief member, may be disposed between the cover top and bottom portions. A plurality of cables extend through the channels disposed in the strain relief members and are attached to the housing quick disconnects. A latching spring assembly that may comprise two latching springs is coupled to the housing and attaches the power cable connector to a receptacle connector, such as a right-angle or straight board connector.

33 Claims, 17 Drawing Sheets

U.S. PATENT DOCUMENTS

| | | | | |
|---|---|---|---|---|
| 3,411,127 | A | 11/1968 | Adams | |
| 3,420,087 | A | 1/1969 | Hatfield et al. | |
| 3,514,740 | A | 5/1970 | Filson et al. | |
| 3,538,486 | A | 11/1970 | Shlesinger, Jr. | 439/268 |
| 3,634,811 | A | 1/1972 | Teagno | 339/47 |
| 3,669,054 | A | 6/1972 | Desso et al. | 113/119 |
| 3,692,994 | A | 9/1972 | Hirschmann et al. | 240/11.4 |
| 3,748,633 | A | 7/1973 | Lundergan | 339/217 |
| 3,845,451 | A | 10/1974 | Neidecker | 339/49 |
| 3,871,015 | A | 3/1975 | Lin et al. | 357/67 |
| 3,942,856 | A | 3/1976 | Mindheim et al. | 339/74 |
| 3,972,580 | A | 8/1976 | Pemberton et al. | 339/47 |
| 4,070,088 | A | 1/1978 | Vaden | 339/252 |
| 4,076,362 | A | 2/1978 | Ichimura | 339/75 |
| 4,082,407 | A | 4/1978 | Smorzaniuk et al. | |
| 4,136,919 | A | 1/1979 | Howard et al. | 339/75 |
| 4,159,861 | A | 7/1979 | Anhalt | 339/75 |
| 4,217,024 | A | 8/1980 | Aldridge et al. | 339/275 |
| 4,260,212 | A | 4/1981 | Ritchie et al. | 339/97 |
| 4,288,139 | A | 9/1981 | Cobaugh et al. | 339/74 |
| 4,371,912 | A | 2/1983 | Guzik | 361/417 |
| 4,383,724 | A | 5/1983 | Verhoevan | 439/510 |
| 4,402,563 | A | 9/1983 | Sinclair | 339/75 |
| 4,403,821 | A | 9/1983 | Zimmerman et al. | 339/97 |
| 4,473,113 | A | 9/1984 | Whitfield et al. | |
| 4,505,529 | A | 3/1985 | Barkus | 439/82 |
| 4,533,187 | A | 8/1985 | Kirkman | |
| 4,536,955 | A | 8/1985 | Gudgeon | 29/840 |
| 4,545,610 | A | 10/1985 | Lakritz et al. | 29/589 |
| 4,552,425 | A | 11/1985 | Billman | 339/47 |
| 4,560,222 | A | 12/1985 | Dambach | 339/75 |
| 4,564,259 | A | 1/1986 | Vandame | 339/258 |
| 4,596,433 | A | 6/1986 | Oesterheld et al. | 339/112 |
| 4,685,886 | A | 8/1987 | Denlinger et al. | 439/55 |
| 4,717,360 | A | 1/1988 | Czaja | 439/710 |
| 4,767,344 | A | 8/1988 | Noschese | 439/83 |
| 4,776,803 | A | 10/1988 | Pretchel et al. | 439/59 |
| 4,782,893 | A | 11/1988 | Thomas | |
| 4,790,763 | A | 12/1988 | Weber et al. | |
| 4,815,987 | A | 3/1989 | Kawano et al. | 439/263 |
| 4,818,237 | A | 4/1989 | Weber | |
| 4,820,169 | A | 4/1989 | Weber et al. | |
| 4,820,182 | A | 4/1989 | Harwath et al. | 439/290 |
| 4,867,713 | A | 9/1989 | Ozu et al. | 439/833 |
| 4,878,611 | A | 11/1989 | LoVasco et al. | 228/180.2 |
| 4,881,905 | A | 11/1989 | Demler, Jr. et al. | 439/79 |
| 4,900,271 | A | 2/1990 | Colleran et al. | 439/595 |
| 4,907,990 | A | 3/1990 | Bertho et al. | 439/851 |
| 4,915,641 | A | 4/1990 | Miskin et al. | |
| 4,963,102 | A | 10/1990 | Gettig et al. | 439/291 |
| 4,965,699 | A | 10/1990 | Jorden et al. | |
| 4,973,257 | A | 11/1990 | Lhotak | 439/81 |
| 4,973,271 | A | 11/1990 | Ishizuka et al. | 439/839 |
| 4,974,119 | A | 11/1990 | Martin | |
| 4,975,084 | A | 12/1990 | Fedder et al. | |
| 4,979,074 | A | 12/1990 | Morley et al. | |
| 5,016,968 | A | 5/1991 | Hammond et al. | |
| 5,024,610 | A | 6/1991 | French et al. | 439/857 |
| 5,035,639 | A | 7/1991 | Kilpatrick et al. | 439/290 |
| 5,046,960 | A | 9/1991 | Fedder et al. | |
| 5,052,953 | A | 10/1991 | Weber | 439/857 |
| 5,066,236 | A | 11/1991 | Broeksteeg | 439/79 |
| 5,077,893 | A | 1/1992 | Mosquera et al. | 29/882 |
| 5,082,459 | A | 1/1992 | Billman et al. | 439/637 |
| 5,094,634 | A | 3/1992 | Dixon et al. | 431/751 |
| 5,104,332 | A | 4/1992 | McCoy | 439/290 |
| 5,137,959 | A | 8/1992 | Block et al. | |
| 5,139,426 | A | 8/1992 | Barkus et al. | |
| 5,151,056 | A | 9/1992 | McClune | |
| 5,152,700 | A | 10/1992 | Bogursky et al. | |
| 5,174,770 | A | 12/1992 | Sasaki et al. | 439/108 |
| 5,194,480 | A | 3/1993 | Block et al. | |
| 5,213,868 | A | 5/1993 | Liberty et al. | |
| 5,214,308 | A | 5/1993 | Nishiguchi | 257/692 |
| 5,238,414 | A | 8/1993 | Yaegashi et al. | 439/108 |
| 5,254,012 | A | 10/1993 | Wang | 439/263 |
| 5,274,918 | A | 1/1994 | Reed | 29/882 |
| 5,276,964 | A | 1/1994 | Anderson, Jr. et al. | |
| 5,286,212 | A | 2/1994 | Broeksteeg | |
| 5,295,843 | A | 3/1994 | Davis et al. | |
| 5,298,791 | A | 3/1994 | Liberty et al. | |
| 5,302,135 | A | 4/1994 | Lee | 439/263 |
| 5,321,582 | A | 6/1994 | Casperson | |
| 5,381,314 | A | 1/1995 | Rudy, Jr. et al. | 361/712 |
| 5,400,949 | A | 3/1995 | Hirvonen et al. | 228/180.22 |
| 5,427,543 | A | 6/1995 | Dynia | 439/346 |
| 5,431,578 | A | 7/1995 | Wayne | 439/259 |
| 5,457,342 | A | 10/1995 | Herbst, II | 257/712 |
| 5,458,426 | A | 10/1995 | Ito | |
| 5,475,922 | A | 12/1995 | Tamura et al. | 29/881 |
| 5,490,040 | A | 2/1996 | Gavdenzi et al. | 361/773 |
| 5,511,987 | A | 4/1996 | Shinchi | |
| 5,512,519 | A | 4/1996 | Hwang | 437/242 |
| 5,533,915 | A | 7/1996 | Deans | 439/678 |
| 5,558,542 | A | 9/1996 | O'Sullivan et al. | 439/682 |
| 5,564,952 | A | 10/1996 | Davis et al. | |
| 5,577,928 | A | 11/1996 | Duclos | 439/290 |
| 5,588,859 | A | 12/1996 | Maurice | 439/290 |
| 5,590,463 | A | 1/1997 | Feldman et al. | 29/844 |
| 5,609,502 | A | 3/1997 | Thumma | 439/747 |
| 5,618,187 | A | 4/1997 | Goto | 439/79 |
| 5,637,008 | A | 6/1997 | Kozel | 439/342 |
| 5,643,009 | A | 7/1997 | Dinkel et al. | |
| 5,664,968 | A | 9/1997 | Mickievicz | |
| 5,664,973 | A | 9/1997 | Emmert et al. | 439/862 |
| 5,667,392 | A | 9/1997 | Kocher et al. | |
| 5,691,041 | A | 11/1997 | Frankeny et al. | 428/209 |
| 5,702,255 | A | 12/1997 | Murphy et al. | 439/71 |
| 5,727,963 | A | 3/1998 | LeMaster | |
| 5,730,609 | A | 3/1998 | Harwath | 439/108 |
| 5,741,144 | A | 4/1998 | Elco et al. | 439/101 |
| 5,741,161 | A | 4/1998 | Cahaly et al. | 439/709 |
| 5,742,484 | A | 4/1998 | Gillette et al. | 361/789 |
| 5,743,009 | A | 4/1998 | Matsui et al. | 29/843 |
| 5,745,349 | A | 4/1998 | Lemke | 361/818 |
| 5,746,608 | A | 5/1998 | Taylor | 439/70 |
| 5,749,746 | A * | 5/1998 | Tan et al. | 439/357 |
| 5,755,595 | A | 5/1998 | Davis et al. | 439/607 |
| 5,772,451 | A | 6/1998 | Dozier, II et al. | 439/70 |
| 5,782,644 | A | 7/1998 | Kiat | |
| 5,787,971 | A | 8/1998 | Dodson | 165/121 |
| 5,795,191 | A | 8/1998 | Preputnick et al. | 439/608 |
| 5,810,607 | A | 9/1998 | Shih et al. | 439/66 |
| 5,817,973 | A | 10/1998 | Elco et al. | 174/32 |
| 5,827,094 | A | 10/1998 | Aizawa et al. | |
| 5,831,314 | A | 11/1998 | Wen | 257/391 |
| 5,857,857 | A | 1/1999 | Fukuda | 439/188 |
| 5,874,776 | A | 2/1999 | Kresge et al. | 257/747 |
| 5,876,219 | A | 3/1999 | Taylor et al. | 439/74 |
| 5,876,248 | A | 3/1999 | Brunker et al. | 439/608 |
| 5,882,214 | A | 3/1999 | Hillbish et al. | |
| 5,883,782 | A | 3/1999 | Thurston et al. | 364/704 |
| 5,888,884 | A | 3/1999 | Wojnarowski | 438/462 |
| 5,908,333 | A | 6/1999 | Perino et al. | 439/631 |
| 5,919,050 | A | 7/1999 | Kehley et al. | 439/71 |
| 5,930,114 | A | 7/1999 | Kuzmin et al. | 361/704 |
| 5,955,888 | A | 9/1999 | Frederickson et al. | 324/761 |
| 5,961,355 | A | 10/1999 | Morlion et al. | 439/686 |
| 5,971,817 | A | 10/1999 | Longueville | 439/857 |
| 5,975,921 | A | 11/1999 | Shuey | 439/83 |
| 5,980,270 | A | 11/1999 | Fjelstad et al. | 439/71 |
| 5,980,321 | A | 11/1999 | Cohen et al. | 439/608 |
| 5,984,726 | A | 11/1999 | Wu | 439/607 |
| 5,993,259 | A | 11/1999 | Stokoe et al. | 439/608 |

6,012,948 A 1/2000 Wu ..... 439/567
6,036,549 A 3/2000 Wulff
6,041,498 A 3/2000 Hillbish et al.
6,050,862 A 4/2000 Ishii ..... 439/843
6,059,170 A 5/2000 Jimarez et al. ..... 228/119
6,066,048 A 5/2000 Lees
6,068,520 A 5/2000 Winings et al. ..... 439/676
6,071,152 A 6/2000 Achammer et al. ..... 439/733.1
6,077,130 A 6/2000 Hughes et al. ..... 439/862
6,089,878 A 7/2000 Meng ..... 439/79
6,095,827 A 8/2000 Dutkowsky et al. ..... 439/83
6,123,554 A 9/2000 Ortega et al. ..... 439/79
6,125,535 A 10/2000 Chiou et al. ..... 29/883
6,139,336 A 10/2000 Olson ..... 439/83
6,146,157 A 11/2000 Lenoir et al. ..... 439/101
6,146,202 A 11/2000 Ramey et al. ..... 439/608
6,146,203 A 11/2000 Elco et al. ..... 439/608
6,152,756 A 11/2000 Huang et al. ..... 439/342
6,174,198 B1 1/2001 Wu et al. ..... 439/541.5
6,180,891 B1 1/2001 Murdeshwar ..... 174/260
6,183,287 B1 2/2001 Po
6,183,301 B1 2/2001 Paagman ..... 439/608
6,190,213 B1 2/2001 Reichart et al. ..... 439/736
6,193,537 B1 2/2001 Harper, Jr. et al. ..... 439/291
6,196,871 B1 3/2001 Szu ..... 439/571
6,202,916 B1 3/2001 Updike et al. ..... 228/180
6,206,722 B1 3/2001 Ko et al.
6,210,197 B1 4/2001 Yu ..... 439/342
6,210,240 B1 4/2001 Comerci et al. ..... 439/853
6,212,755 B1 4/2001 Shimada et al. ..... 29/527.1
6,215,180 B1 4/2001 Chen et al. ..... 257/720
6,219,913 B1 4/2001 Uchiyama ..... 29/883
6,220,884 B1 4/2001 Lin ..... 439/342
6,220,895 B1 4/2001 Lin ..... 439/607
6,220,896 B1 4/2001 Bertoncini et al. ..... 439/608
6,234,851 B1 5/2001 Phillips ..... 439/825
6,238,225 B1 5/2001 Middlehurst et al.
6,257,478 B1 7/2001 Straub ..... 228/6.2
6,259,039 B1 7/2001 Chroneos, Jr. et al. ..... 174/263
6,261,132 B1 7/2001 Koseki et al.
6,269,539 B1 8/2001 Takahashi et al. ..... 29/883
6,274,474 B1 8/2001 Caletka et al. ..... 438/613
6,280,230 B1 8/2001 Takase et al.
6,293,827 B1 9/2001 Stokoe et al. ..... 439/608
6,299,492 B1 10/2001 Pierini et al. ..... 439/884
6,309,245 B1 10/2001 Sweeney ..... 439/507
6,319,075 B1 11/2001 Clark et al. ..... 439/825
6,322,377 B2 11/2001 Middlehurst et al.
6,328,602 B1 12/2001 Yamasaki et al. ..... 439/608
6,347,952 B1 2/2002 Hasegawa et al. ..... 439/608
6,350,134 B1 2/2002 Fogg et al. ..... 439/79
6,359,783 B1 3/2002 Noble ..... 361/704
6,360,940 B1 3/2002 Bolde et al. ..... 228/264
6,362,961 B1 3/2002 Chiou ..... 361/704
6,363,607 B1 4/2002 Chen et al. ..... 29/883
6,371,773 B1 4/2002 Crofoot et al. ..... 439/79
6,379,188 B1 4/2002 Cohen et al. ..... 439/608
6,386,924 B2 5/2002 Long
6,394,818 B1 5/2002 Smalley, Jr.
6,402,566 B1 6/2002 Middlehurst et al.
6,409,543 B1 6/2002 Astbury, Jr. et al. ..... 439/608
6,428,328 B2 8/2002 Haba et al. ..... 439/70
6,431,914 B1 8/2002 Billman ..... 439/608
6,435,914 B1 8/2002 Billman ..... 439/608
6,450,829 B1 9/2002 Weisz-Margulescu
6,461,183 B1 10/2002 Ohkita et al.
6,461,202 B2 10/2002 Kline ..... 439/701
6,471,523 B1 10/2002 Shuey ..... 439/63
6,471,548 B2 10/2002 Bertoncini et al. ..... 439/608
6,472,474 B2 10/2002 Burkhardt et al.
6,448,549 B1 12/2002 Weller et al.
6,489,567 B2 12/2002 Zachrai
6,506,081 B2 1/2003 Blanchfield et al. ..... 439/682
6,514,103 B2 2/2003 Pape et al. ..... 439/608
6,537,111 B2 3/2003 Brammer et al. ..... 439/857
6,544,046 B1 4/2003 Hahn et al. ..... 439/83
6,551,112 B1 4/2003 Li et al. ..... 439/66
6,554,647 B1 4/2003 Cohen et al. ..... 439/607
6,572,410 B1 6/2003 Volstorf et al. ..... 439/608
6,575,774 B2 6/2003 Ling et al.
6,575,776 B1 6/2003 Conner et al.
6,592,381 B2 7/2003 Cohen et al. ..... 439/80
6,604,967 B2 8/2003 Middlehurst et al.
6,629,854 B2 10/2003 Murakami
6,652,318 B1 11/2003 Winings et al. ..... 439/608
6,663,426 B2 12/2003 Hasircoglu et al. ..... 439/608
6,665,189 B1 12/2003 Lebo ..... 361/730
6,669,514 B2 12/2003 Weibking et al. ..... 439/701
6,672,884 B1 1/2004 Toh et al.
6,672,907 B2 1/2004 Azuma ..... 439/682
6,692,272 B2 2/2004 Lemke et al. ..... 439/108
6,702,594 B2 3/2004 Lee et al. ..... 439/83
6,705,902 B1 3/2004 Yi et al. ..... 439/678
6,712,621 B2 3/2004 Li et al. ..... 439/65
6,716,068 B2 4/2004 Wu ..... 439/733.1
6,740,820 B2 5/2004 Cheng ..... 174/260
6,743,037 B2 6/2004 Kassa et al. ..... 439/342
6,746,278 B2 6/2004 Nelson et al. ..... 439/608
6,769,883 B2 8/2004 Brid et al.
6,769,935 B2 8/2004 Stokoe et al. ..... 439/608
6,776,635 B2 8/2004 Blanchfield et al. ..... 439/181
6,776,649 B2 8/2004 Pape et al. ..... 439/485
6,780,027 B2 8/2004 Allison
6,790,088 B2 9/2004 Ono et al. ..... 439/607
6,796,831 B1 9/2004 Yasufuku et al. ..... 439/485
6,810,783 B1 11/2004 Larose
6,811,440 B1 11/2004 Rothermel et al. ..... 439/608
6,814,590 B2 11/2004 Minich et al.
6,829,143 B2 12/2004 Russell et al. ..... 361/704
6,835,103 B2 12/2004 Middlehurst et al. ..... 439/699.1
6,843,687 B2 1/2005 McGowan et al. ..... 439/608
6,848,886 B2 2/2005 Schmaling et al. ..... 416/134
6,848,950 B2 2/2005 Allison et al. ..... 439/682
6,848,953 B2 2/2005 Schell et al. ..... 439/825
6,869,294 B2 3/2005 Clark et al. ..... 439/79
6,884,117 B2 4/2005 Korsunsky et al. ..... 439/607
6,890,221 B2 5/2005 Wagner ..... 439/855
6,905,367 B2 6/2005 Crane, Jr. et al. ..... 439/608
6,929,504 B2 8/2005 Ling et al. ..... 439/485
6,947,012 B2 9/2005 Aisenbrey ..... 343/906
6,975,511 B1 12/2005 Lebo et al. ..... 361/703
6,994,569 B2 2/2006 Minich et al. ..... 439/79
7,001,189 B1 2/2006 McGowan et al. ..... 439/79
7,059,892 B1 6/2006 Trout
7,059,919 B2 6/2006 Clark et al.
7,065,871 B2 6/2006 Minich et al.
7,070,464 B2 7/2006 Clark et al. ..... 439/825
7,074,096 B2 7/2006 Copper et al. ..... 439/843
7,097,465 B1 8/2006 Korsunsky et al.
7,101,228 B2 9/2006 Hamner et al. ..... 439/637
7,104,812 B1 9/2006 Bogiel et al. ..... 439/79
7,114,963 B2 10/2006 Shuey et al. ..... 439/79
RE039,380 E 11/2006 Davis
7,137,848 B1 11/2006 Trout et al.
7,168,963 B2 1/2007 Minich et al. ..... 439/79
7,182,642 B2 2/2007 Ngo et al. ..... 439/608
7,204,699 B2 4/2007 Stoner
D542,736 S 5/2007 Riku ..... D13/147
7,220,141 B2 5/2007 Daily et al.
7,258,562 B2 8/2007 Daily et al.
7,273,382 B2 9/2007 Igarashi et al. ..... 439/141
7,303,427 B2 12/2007 Swain
7,335,043 B2 2/2008 Hgo et al.
7,384,289 B2 6/2008 Minich
7,425,145 B2 9/2008 Ngo
7,458,839 B2 12/2008 Ngo

| | | | | |
|---|---|---|---|---|
| 7,476,108 | B2 | 5/2009 | Swain et al. | |
| 2001/0003685 | A1 | 6/2001 | Aritani | 439/485 |
| 2001/0049229 | A1 | 12/2001 | Pape et al. | |
| 2002/0106930 | A1 | 8/2002 | Pape et al. | 439/485 |
| 2002/0142676 | A1 | 10/2002 | Hosaka et al. | 439/874 |
| 2002/0159235 | A1 | 10/2002 | Miller et al. | 361/704 |
| 2002/0193019 | A1 | 12/2002 | Blanchfield et al. | 439/857 |
| 2003/0013330 | A1 | 1/2003 | Takeuchi | 439/83 |
| 2003/0119378 | A1 | 6/2003 | Avery | |
| 2003/0143894 | A1 | 7/2003 | Kline et al. | 439/608 |
| 2003/0219999 | A1 | 11/2003 | Minich et al. | 439/79 |
| 2003/0220021 | A1 | 11/2003 | Whiteman, Jr. et al. | 439/608 |
| 2003/0236035 | A1 | 12/2003 | Kuroda et al. | 439/857 |
| 2004/0147177 | A1 | 7/2004 | Wagner | |
| 2004/0183094 | A1 | 9/2004 | Caletka et al. | 257/178 |
| 2005/0112952 | A1 | 5/2005 | Wang et al. | 439/660 |
| 2006/0003620 | A1 | 1/2006 | Daily et al. | 439/295 |
| 2006/0128197 | A1 | 6/2006 | McGowan et al. | |
| 2006/0228927 | A1 | 10/2006 | Daily | |
| 2006/0228948 | A1 | 10/2006 | Swain | |
| 2006/0281354 | A1 | 12/2006 | Ngo et al. | 439/290 |
| 2007/0197063 | A1 | 8/2007 | Ngo | |
| 2007/0202748 | A1 | 8/2007 | Daily | |
| 2007/0275586 | A1 | 11/2007 | Ngo | |
| 2007/0293084 | A1 | 12/2007 | Ngo | |
| 2008/0038956 | A1 | 2/2008 | Swain | |
| 2008/0248670 | A1 | 10/2008 | Daily et al. | |

FOREIGN PATENT DOCUMENTS

| | | | |
|---|---|---|---|
| DE | 102 26 279 | C1 | 11/2003 |
| EP | 0 273 683 | A2 | 7/1988 |
| EP | 0 321 257 | B1 | 4/1993 |
| EP | 0 623 248 | B1 | 11/1995 |
| EP | 0 789 422 | A2 | 8/1997 |
| EP | 1 091 449 | B1 | 9/2004 |
| GB | 1 162 705 | | 8/1969 |
| JP | 05344728 | | 12/1993 |
| JP | 668943 | | 3/1994 |
| JP | 06-236788 | | 8/1994 |
| JP | 07-114958 | | 5/1995 |
| JP | 07169523 | | 7/1995 |
| JP | 08096918 | | 4/1996 |
| JP | 0 812 5379 | | 5/1996 |
| JP | 9199215 | | 7/1997 |
| JP | 2000-003743 | | 1/2000 |
| JP | 2000-003744 | | 1/2000 |
| JP | 2000-003745 | | 1/2000 |
| JP | 2000-003746 | | 1/2000 |
| JP | 13135388 | | 5/2001 |
| JP | 2003-217785 | | 7/2003 |
| KR | 100517561 | B1 | 9/2005 |
| TW | 576555 | | 8/1990 |
| TW | 546872 | | 8/2003 |
| WO | WO 97/43885 | | 11/1997 |
| WO | WO 97/44859 | | 11/1997 |
| WO | WO 98/15989 | | 4/1998 |
| WO | WO 0016445 | | 3/2000 |
| WO | WO 01/29931 | A1 | 4/2001 |
| WO | WO 01/39332 | A1 | 5/2001 |
| WO | WO 02103847 | | 12/2002 |
| WO | WO 2005065254 | | 7/2005 |
| WO | WO 2007064632 | | 6/2007 |
| WO | WO 2008117180 | A2 | 10/2008 |

OTHER PUBLICATIONS

Sherman, L.M., "Plastics that Conduct Heat", Plastics Technology Online, Jun. 2001, http://www.plasticstechnology.com, 4 pages.

Ogando, J., "And now-An Injection-Molded Heat Exchanger", Sure, plastics are thermal insulators, but additive packages allow them to conduct heat instead, Global Design News, Nov. 1, 2000, 4 pages.

Power TwinBlade™ I/O Cable Connector RA-North-South, No. GS-20_072, Aug. 6, 2007, 11 pages.

U.S. Appl. No. 12/317,366, filed Dec. 22, 2008, Minich.

Metral 1000 Series, PCB Mounted Receptacle Assembly, FCI Web Site page, 2001, 1 p.

Power TwinBlade™ I/O Cable Connector RA-North-South, No. GS-20_072, Aug. 6, 2007, 11 pages.

Product Datasheets, 10 Bgit/s XENPAK 850 nm Transponder (TRP1OGVP2045), Copyright 2005, MergeOptics GmbH, 13 pages.

Product Datasheets, Welome to XENPAK.org., Copyright 2001, http://www.xenpak.org., 1 page.

* cited by examiner

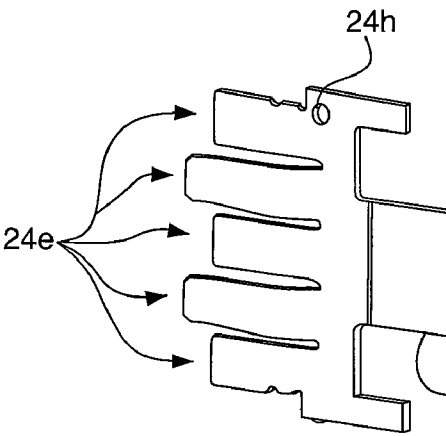
FIG. 16A
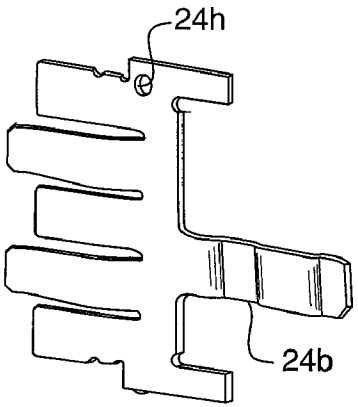
FIG. 16C
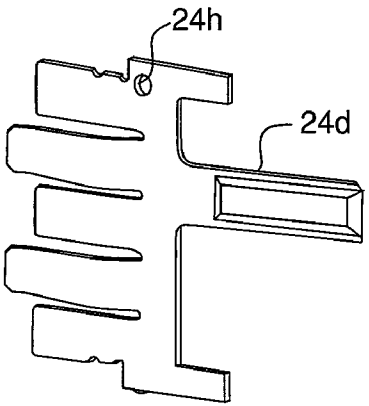
FIG. 16E
FIG. 16B
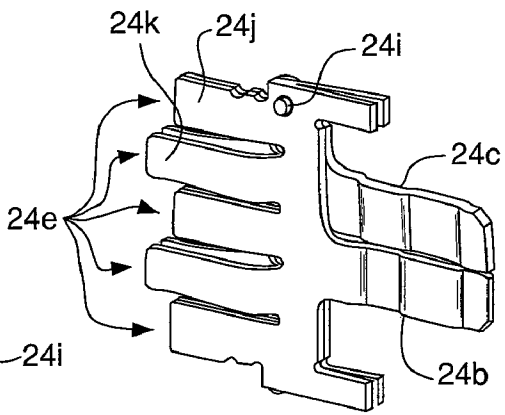
FIG. 16D
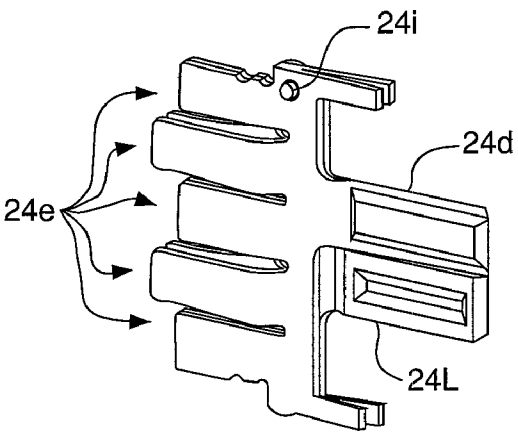
FIG. 16F

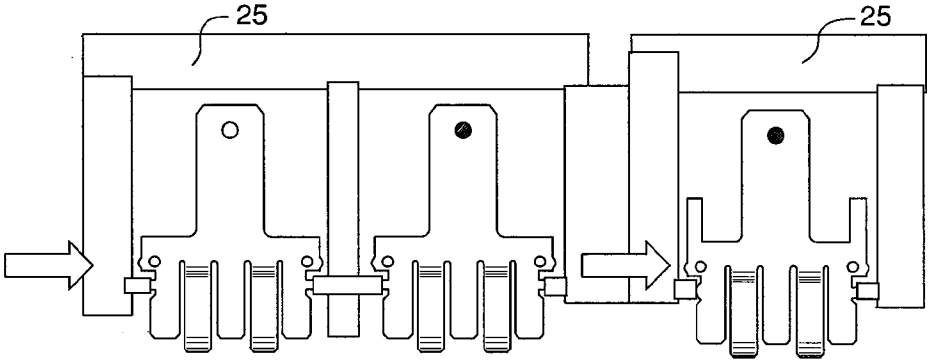
FIG. 24
FIG. 23
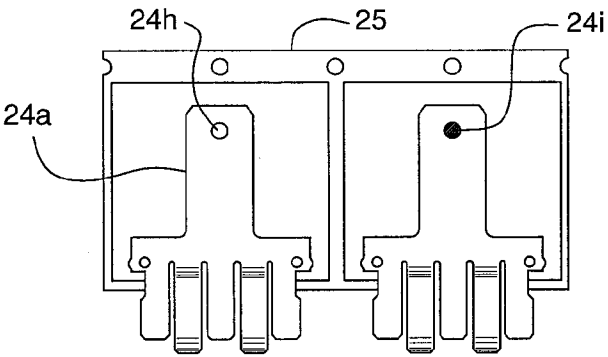
FIG. 22
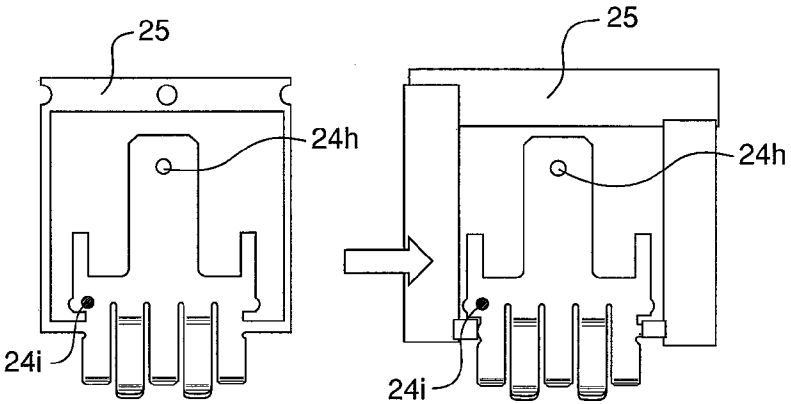
FIG. 28
FIG. 27
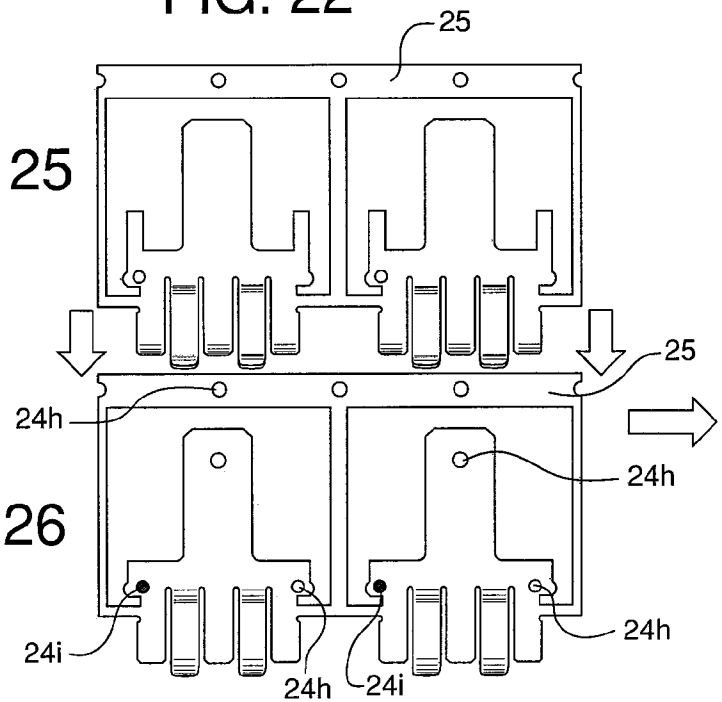
FIG. 25
FIG. 26

POWER CABLE CONNECTOR SYSTEM

CROSS REFERENCE TO RELATED APPLICATIONS

This application claims the benefit of the filing date of Provisional Application No. 60/910,178, filed Apr. 4, 2007, the contents of all of which are incorporated by reference herein. This application is related by subject matter to U.S. patent application Ser. No. 12/109,750 filed Apr. 25, 2008, and is further related by subject matter to U.S. patent application Ser. No. 11/751,351 filed May 21, 2007.

FIELD OF THE INVENTION

This invention relates generally to power cable connectors, methods of making them, and power cable connector assemblies.

BACKGROUND OF THE INVENTION

This invention relates generally to power cable connectors. Generally, power cable connectors mate with board mounted headers to transfer power from a power source to a load. For example, the assignee of this invention, FCI America Technologies, Inc., (FCI) sells power cable connectors under the trade names PwrBlade® and PwrTwinBlade™.

FCI's Pwr TwinBlade™ product is designed to support applications that demand the supply of high power. This product has a touch-proof design that supports currents of up to 100 Amps per twin-contact. The Pwr TwinBlade product can be mated with either a straight or a right-angle board connector to form a connector system. Further, the Pwr TwinBlade has an active latch for coupling it to a board connector. Also, the design provides capability for termination of various cable diameters and wire sizes of 6 AWG and 10 AWG. While FCI's Pwr TwinBlade™ product has been successful, the need exists for an improved power cable connector.

SUMMARY OF THE INVENTION

This invention relates to an improved power cable connector. In an embodiment, the improved power cable connector of this invention has a housing comprising a bottom portion and a top portion and a plurality of passages that are each used for receiving a receptacle contact. The housing further comprises a plurality of quick-disconnect contacts each disposed in one of the passages that are for mating with receptacle contacts. The quick disconnects permit the power cable connector to be quickly disconnected from the receptacle connector. Preferably, the power cable connector has five quick disconnects.

The invention may also include a cover that is coupled to the housing. In an embodiment, the cover may comprise a top portion and a bottom portion; and a strain relief member, disposed between the cover top and bottom portions. The strain relief member preferably has a plurality of channels, and power cables that extend through the cover channels to the quick disconnects. The power cable connectors are mechanically and electrically connected to the quick-disconnects to transfer power from a power source through the quick disk-connects and to the receptacle.

In addition, the invention may also include a latching spring, coupled to the housing, for attaching a receptacle connector to the housing. The latching spring provides a spring release connection for coupling the cable connector to a receptacle contact. In an embodiment, the latching spring comprises dual latches that are disposed off-center from the housing center line.

The power cable connector quick disconnects can mate with a variety of receptacle connector contacts. For example, the receptacle connector contacts may be blade contacts that mate with the quick disconnects. This invention can include the system that is formed by mating with the power cable connector with the receptacle connector, which may be either a straight or right-angle board connector.

Preferably, the latching springs attach the power cable connector to the receptacle connector. The receptacle connector may have a plurality of holes, so that when the receptacle connector is attached to the power cable connector the latch springs deflect into the holes to couple the cable connector to the receptacle connector. In order to release the cable connector, the springs are deflected downward out of the holes thereby releasing the receptacle connector from the cable connector.

This invention also includes a method of assembling a power cable connector. Preferably, this inventive method uses top loading to manufacture the power cable connector. The method may include the steps of threading the power cables through channels in a strain relief member and threading the cables through lacthing springs. Following this step, quick disconnects are attached, preferably by crimping, onto the power cables. Afterwhich, the quick disconnects may be placed in slots in the cable connector housing. Preferably, the cable connector housing has two parts and the slots are disposed in the housing bottom portion. This permits a top loading manufacturing method to be sued to install the quick disconnects. After installing the quick disconnects, the housing top portion may be attached to the housing bottom portion.

A bottom cover may then be installed under the strain relief member. After which, a top cover is preferably attached to the bottom cover. In a preferred embodiment, one or more mechanical fasteners are used to attach the top cover to the bottom cover.

BRIEF DESCRIPTION OF THE DRAWINGS

FIG. 16A is a perspective view of a first preferred embodiment of a blade contact of a receptacle connector for mating with the power cable connector according to a preferred embodiment of this invention;

FIG. 16B is a perspective view of the preferred embodiment of FIG. 16A;

FIG. 16C is a perspective view of a second preferred embodiment of a blade contact of a receptacle connector for mating with the power cable connector according to a preferred embodiment of this invention;

FIG. 16D is perspective view of the preferred embodiment of FIG. 16C;

FIG. 16E is a perspective view of a third preferred embodiment of a blade contact of a receptacle connector for mating with the power cable connector according to a preferred embodiment of this invention;

FIG. 16F is a perspective view of the embodiment of FIG. 16E;

FIG. 22 is a side view of a preferred embodiment of the contact of preferred embodiment of FIG. 17 according to a preferred embodiment of this invention during the manufacturing process with a carrier;

FIG. 23 is a side view of the preferred embodiment of the contacts of FIG. 22 during the manufacturing process according to a preferred embodiment of this invention;

FIG. 24 is a side view of the preferred embodiment of the contacts of FIG. 22 during the manufacturing process according to a preferred embodiment of this invention;

FIG. 25 is a side view of the preferred embodiment of the contacts of FIG. 22 according to a preferred embodiment of this invention during the manufacturing process;

FIG. 26 is a side view of the preferred embodiment of the contacts of FIG. 22 according to a preferred embodiment of this invention during the manufacturing process;

FIG. 27 is a side view of the preferred embodiment of the contacts of FIG. 22 according to a preferred embodiment of this invention during the manufacturing process;

FIG. 28 is a side view of the preferred embodiment of the contacts of FIG. 22 according to a preferred embodiment of this invention during the manufacturing process;

DETAILED DESCRIPTION OF ILLUSTRATIVE EMBODIMENTS

Figure 2:
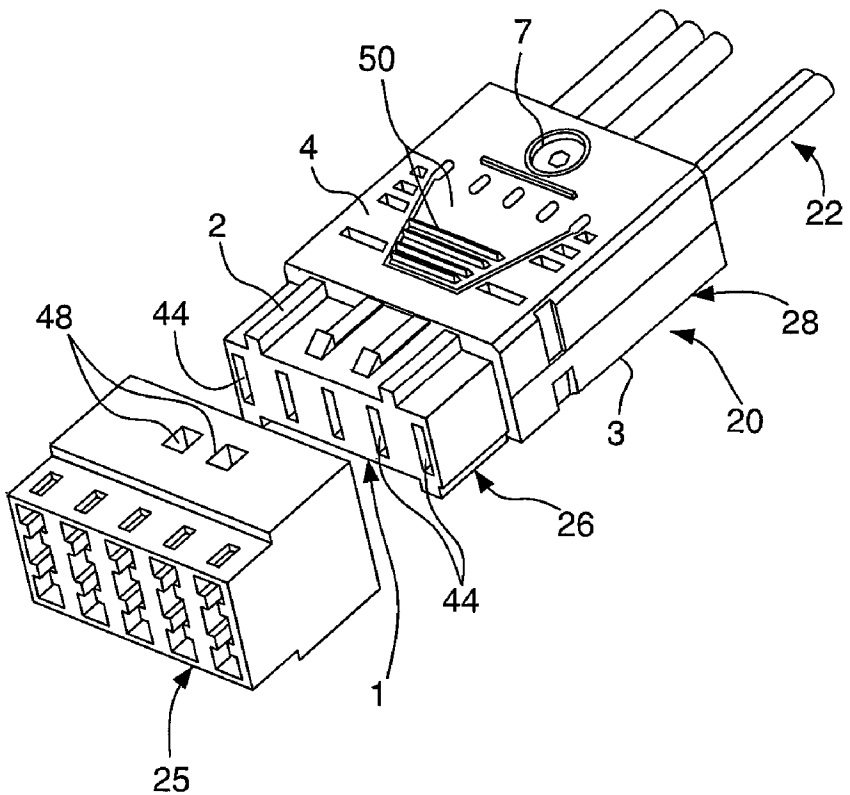
FIG. 2 is a perspective view of a power cable connector and a mating receptacle connector according to a preferred embodiment of this invention.
Figure 1:
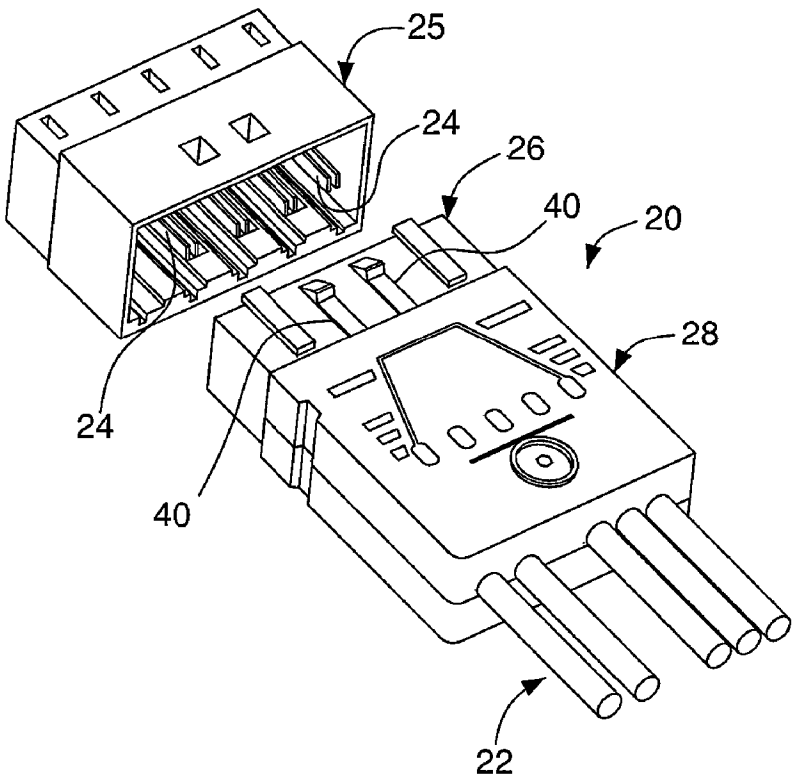
FIG. 1 is a perspective view of a power cable connector and a mating receptacle connector according to a preferred embodiment of this invention.

A preferred embodiment of a power cable connector 20 is depicted in FIGS. 1-13. Also depicted in FIGS. 1 and 2 is a receptacle connector 25 that can mate with the power cable connector 20. The receptacle connector 25 can be a board connector and is preferably either a straight board connector a right-angle board connector. The board is not shown, but those skilled in the art will appreciate that any suitable electrical board can be mechanically and electrically coupled to the receptacle connector 25. The power cable connector 20 can be electrically and mechanically connected to the receptacle connector 25 to provide an electrical path from a power source, which is electrically coupled to the power cable connector 20, and a load, which is electrically coupled to the receptacle connector 25.

Figure 3:
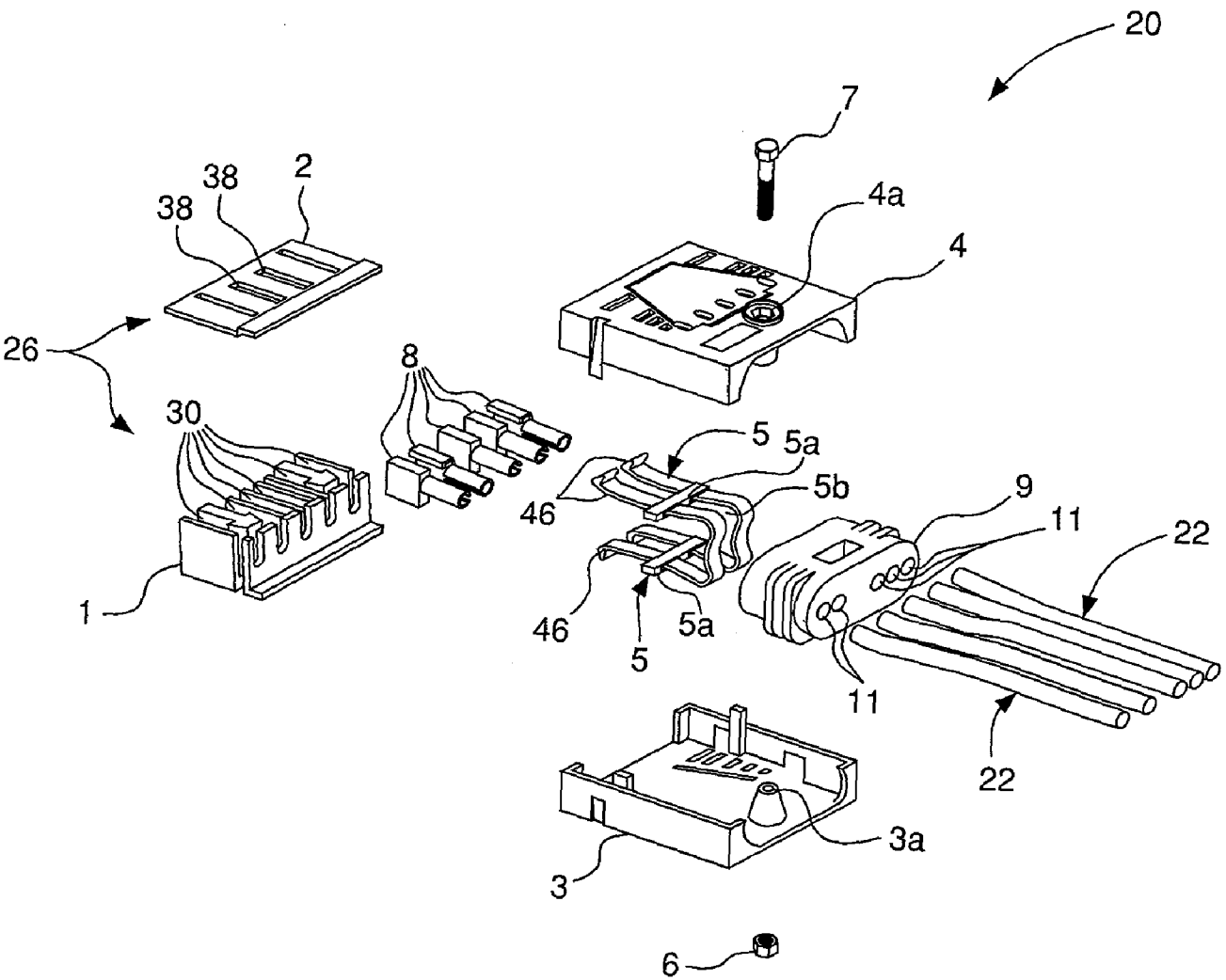
FIG. 3 is an exploded view of the power cable connector of FIG. 1 according to a preferred embodiment of this invention.
Figure 13:
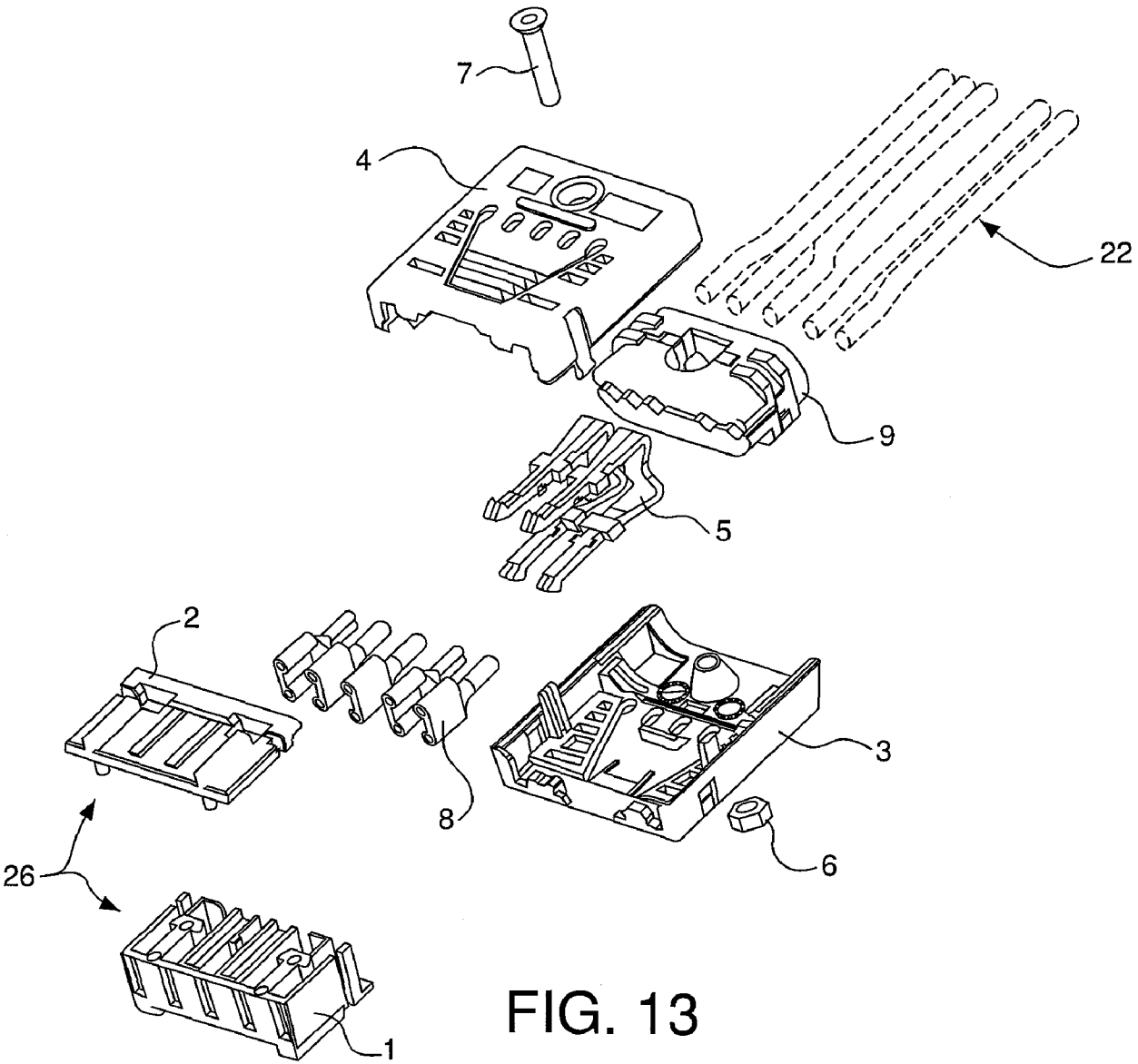
FIG. 13 is an exploded view of the power cable connector of FIG. 1 according to a preferred embodiment of this invention.

FIGS. 3 and 13 are exploded views of the power cable connector 20 according to a preferred embodiment of this invention and can be used to best understand the components of the preferred embodiment of the power cable connector 20 of this invention. FIGS. 12A-12D are top, front, side and perspective views of the preferred embodiment of this invention and can also be used to understand the components of the preferred embodiment of this invention. FIGS. 4-11 show various preferable components of the power cable connector 20 according to a preferred embodiment and will be referenced as those elements are explained below.

Figure 6:
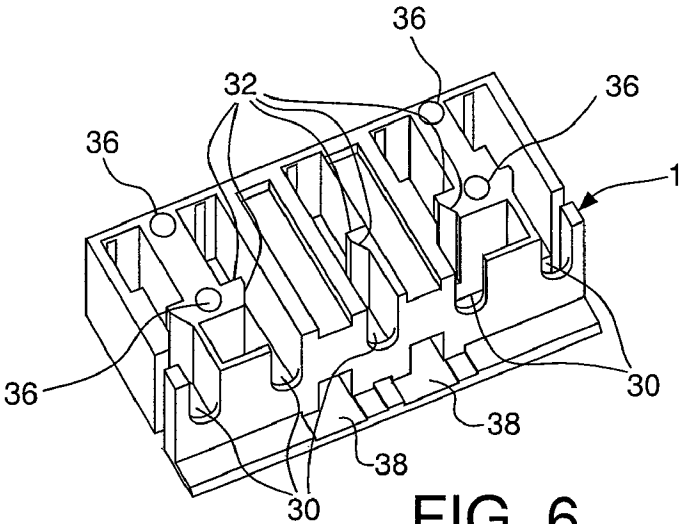
FIG. 6 is a perspective view of a bottom portion of the housing of the power cable connector of FIG. 1 according to a preferred embodiment of this invention.
Figure 7:
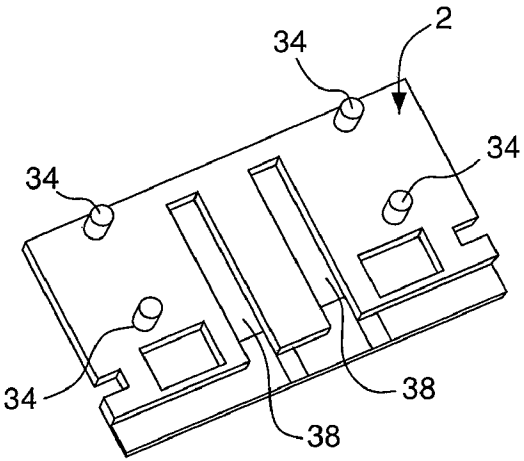
FIG. 7 is a perspective view of the top portion of the housing of the power cable connector of FIG. 1 according to a preferred embodiment of this invention.

In the preferred embodiment shown, the connector 20 comprises a housing 26 and a cover 28, as shown in FIGS. 1 and 2. Preferably, the housing 26 has a bottom portion 1 and a top portion 2, as shown in FIGS. 3 and 13. The housing bottom and top portions 1, 2 can be constructed form any suitable material, and in a preferred embodiment they are high temperature nylon. The housing bottom and top portions 1, 2 are best shown in FIGS. 6 and 7. The housing top portion 2 can be attached to the housing bottom portion 1 by any of a variety of means including fasteners or adhesives. The bottom portion 1 and the top portion 2 can include features that help to properly align the top portion 2 and the bottom portion 1. For example, the top portion 2 can have a plurality of projections 34, as shown in FIG. 7, and the bottom portion 1 can have a plurality of holes 36, as shown in FIG. 6, that each receive a corresponding projection 34 when the top portion 2 and the bottom portion 1 are properly aligned.

The housing bottom portion preferably has a plurality of slots 30 as shown in FIG. 6. As is best understood with reference to FIGS. 3, 4 and 6, disposed within the slots 30 are a plurality of quick disconnects 8. The quick disconnects 8 are mechanically and electrically connected to the power cables 22, as is best understood with reference to FIGS. 3 and 4. The quick disconnects 8 or contacts are for mating with receptacle contacts to provide an electrical connection between the receptacle and the power cables. In the preferred embodiment shown, there are five quick disconnects 8, but it will be appreciated that any number of quick disconnects 8 and associated power cables can be used. It will also be appreciated that contacts other than quick disconnects can be used in alternative embodiments. The quick disconnects 8 are constructed from any suitable electrical conductive material and most preferably tin-plated brass.

The housing bottom portion 1 can include surfaces 32, shown in FIG. 6, that engage complementary surfaces on the contacts 8. These surfaces 32 help to center each contact 8 within its associated slot 30, and resist mating and un-mating forces that could otherwise displace the contacts 8 from their proper positions within the bottom portion 1 of the housing 26.

The bottom portion 1 of the housing 26 has slots 44, as shown in FIG. 2, formed therein that permit the blades 24 of the receptacle connector 25 to enter the housing and engage the connectors 8 when the power cable connector 20 and the receptacle connector are mated.

Disposed within the power cable connector 20 is a strain relief member 9, as depicted in FIG. 3. The strain relief member 9 can be made of any suitable material such as an electrometric material or nylon. The strain relief member 9 preferably has passages 11 that extend through the strain relief member 9, as shown in FIG. 3. The passages may be off center from the centerline of the power cable connector 20, so that there is sufficient space for the latch springs 5 as explained below.

Figure 4:
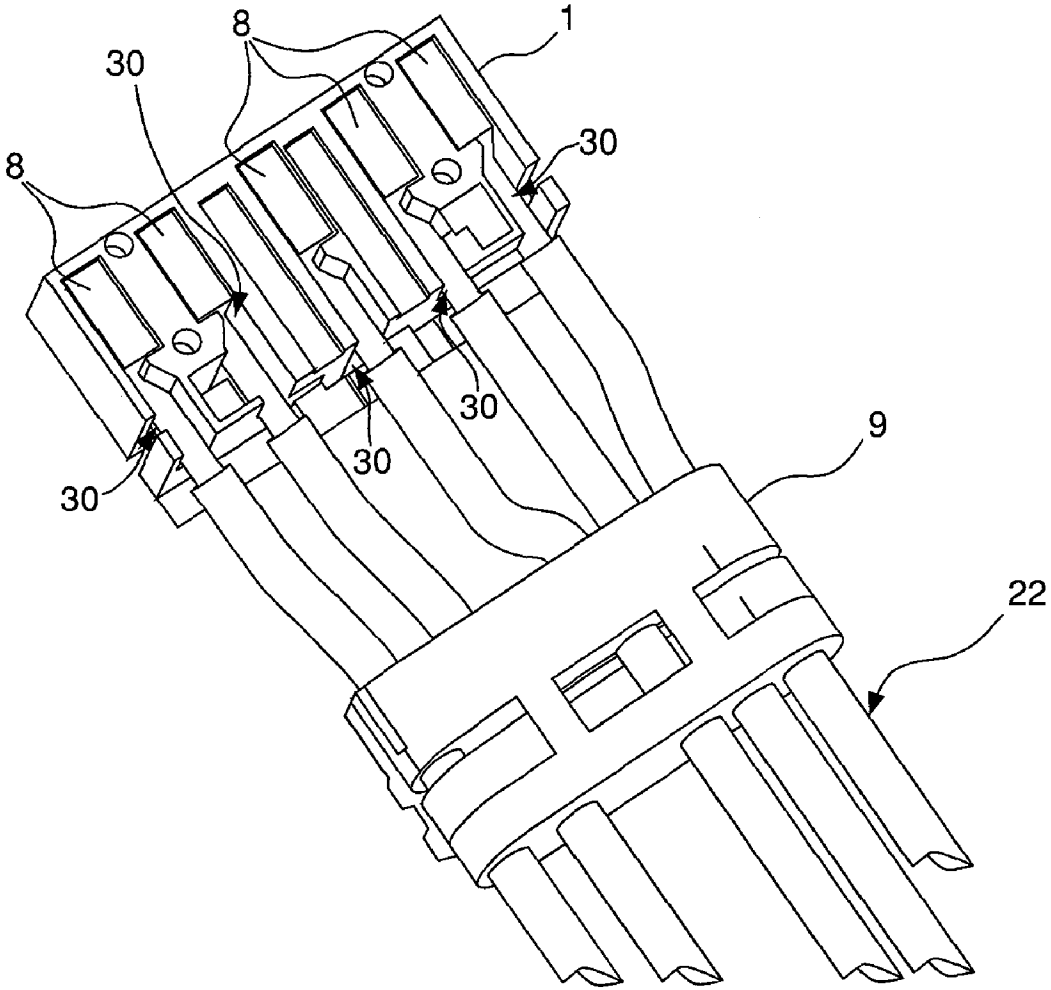
FIG. 4 is a perspective view of the contacts and cable of the power cable connector of FIG. 1 according to a preferred embodiment of this invention.

As shown in FIGS. 1-4, power cables 22 extend through the passages 11 in the strain relief member 9. It will be appreciated that the power cables 22 are connected to a power source, which is not shown. The power cables can be any suitable cables, but in a preferred embodiment they are 12 gage wire. The power cables 22 preferably extend through the strain relief passages 11 and through a passage **5*b* defined by the latching springs 5, such that the ends of the power cables 22 extend outside of the strain relief member 9. and are attached to the quick disconnects 8 to provide an electrical path from a power source to the quick disconnects 8, as is best shown in FIG. 4. In a preferred embodiment, the quick disconnects 8 are crimped onto the ends of the power cables 22. It will be appreciated, however, that the quick disconnects can be attached to the power cables 22** by any other suitable means.

Figure 10:
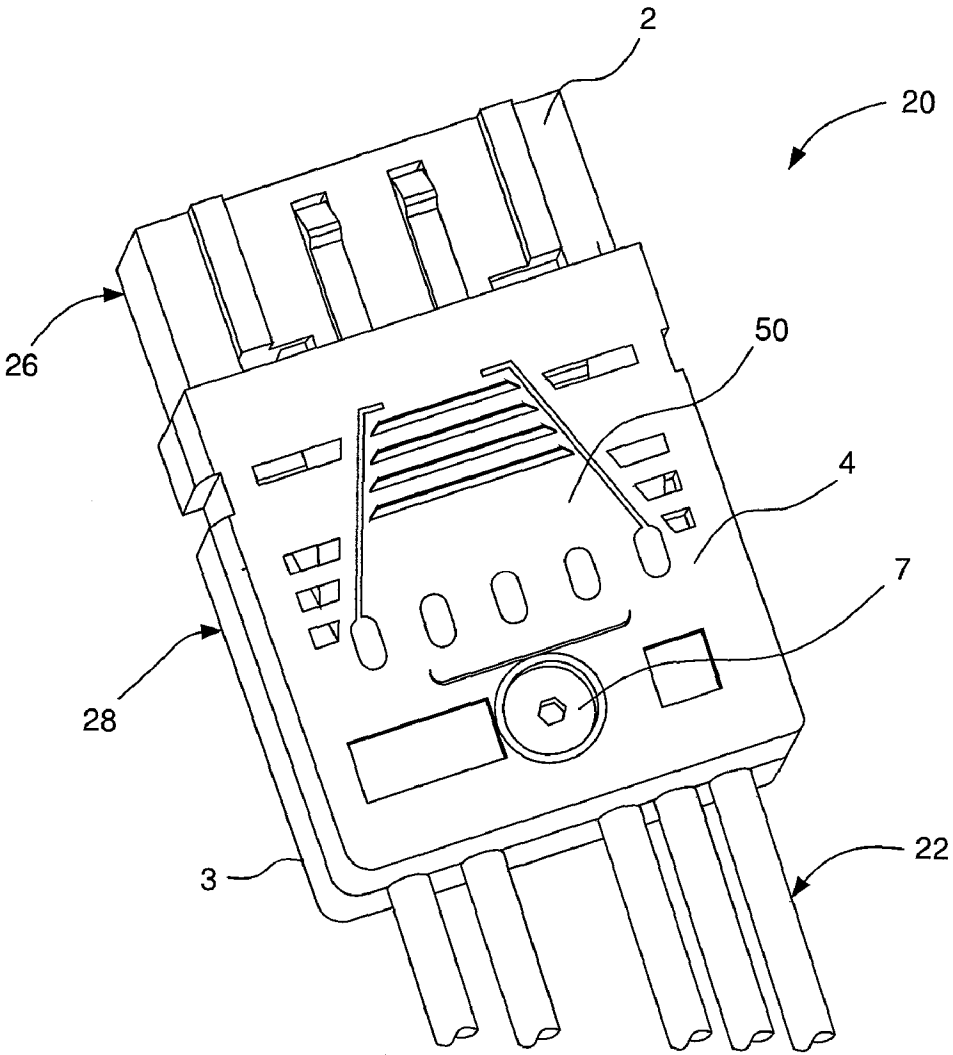
FIG. 10 is a perspective view of parts of the power cable connector of FIG. 1 according to a preferred embodiment of this invention.
Figure 11:
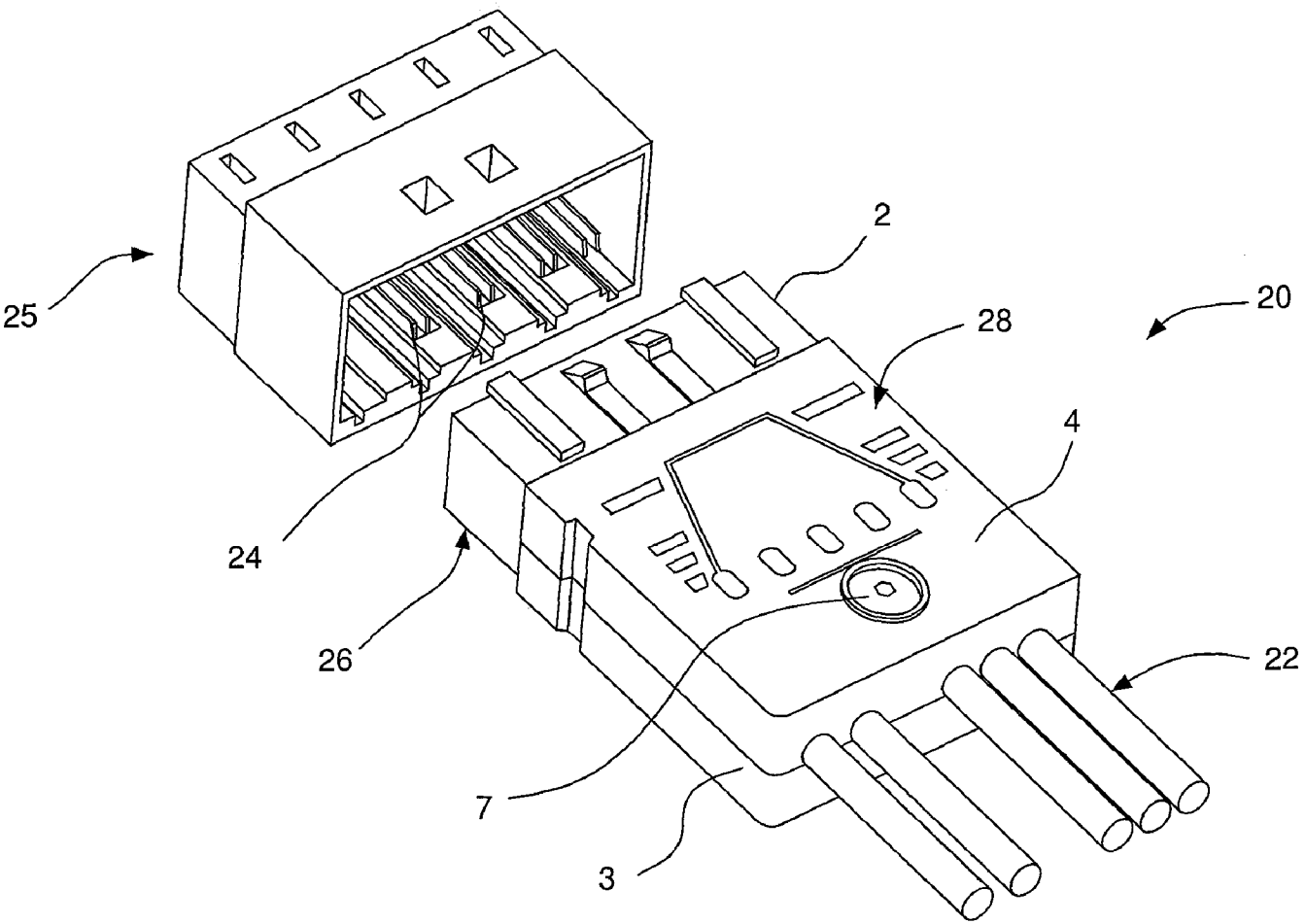
FIG. 11 is a perspective view of a power cable connector and a mating receptacle connector according to a preferred embodiment of this invention.
Figure 12D:
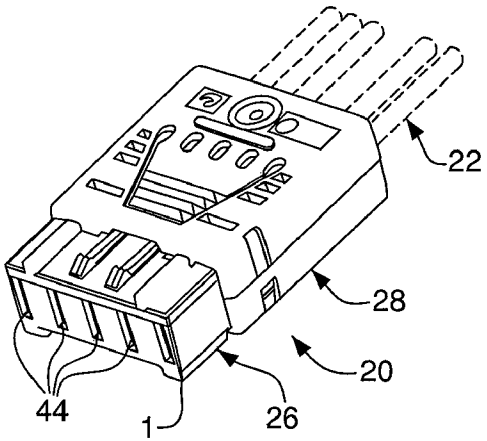
FIG. 12D is a perspective view of the power cable connector of FIG. 1 according to a preferred embodiment of this invention.
Figure 12C:
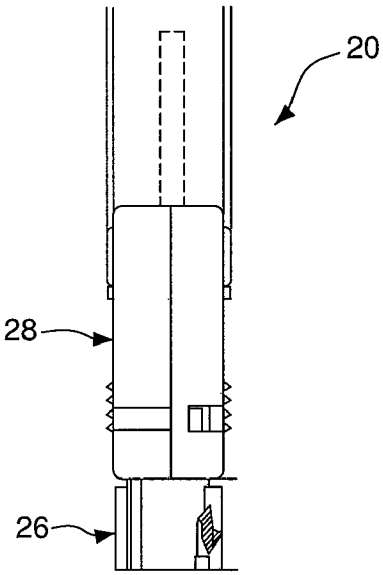
FIG. 12C is a side view of the power cable connector of FIG. 1 according to a preferred embodiment of this invention.
Figure 12A:
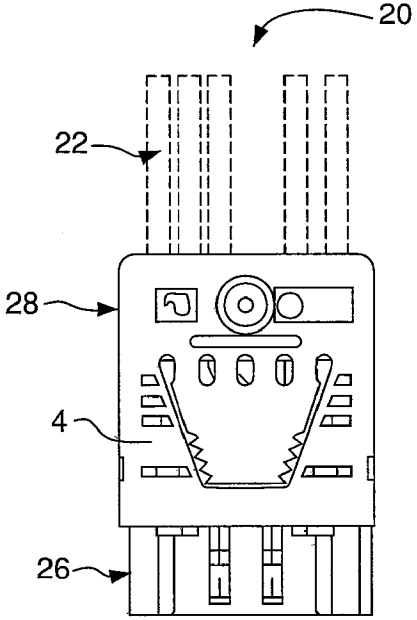
FIG. 12A is a top view of the power cable connector of FIG. 1 according to a preferred embodiment of this invention.
Figure 12B:
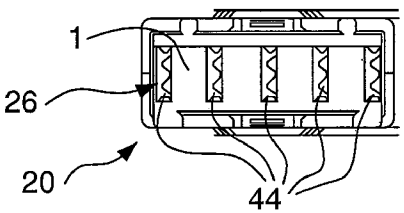
FIG. 12B is a back view of the power cable connector of FIG. 1 according to a preferred embodiment of this invention.

The connector 20 further comprises a cover 28 comprising a bottom portion 3 and a top portion 4, as shown in FIG. 3. The cover 28 is preferably constructed from an thermoplastic material and most preferably high temperature nylon. The cover top portion 4 and bottom portion 3 are mated and assembled together as best shown in FIGS. 3, 10, and 11. It will be appreciated that any suitable means can be used to affix the cover top portion 4 to the bottom portion 3. In the preferred embodiment shown a mechanical fastener 7 is used to connect the cover top and bottom portions. The mechanical fastener 7 is preferably a screw and the cover top portion 4 has a hole **4*a*, shown in FIG. 3, through which the screw extends and the cover bottom portion 3 has a hole 3*a*, shown in FIG. 3, for receiving the fastener 7. The fastener 7 preferably extends through the hole 3*a* and a nut 6, shown in FIG. 3, is used to fix the fastener 7** in place and thereby attach the top and bottom cover portions.

Preferably, the connector 20 also comprises latching springs 5, shown in FIGS. 3 and 13 The latching springs function to mechanically connect the connector 20 to the receptacle 25. There are preferably two latching springs 5. The latching springs 5 preferably are made of a resilient material such as a metal or a thermoplastic material and most preferably high temperature nylon. The latching springs 5 may be connected by lateral member **5*a*. Also, the latching springs 5 may have a beam portion 40 and lips 46** that are for attaching the latching spring to the receptacle assembly.

Although the properties of the latching springs can be tailored to the specific application, in a preferred embodiment, the latching springs are designed to withstand a minimum of 150 newtons of retention forces and permit the connector to release from a receptacle at a maximum of force of 250 newtons. The mating force is approximately 3 pounds per contact in this preferred embodiment, so for the five contact connector shown, the mating force is about 15 lbs.

Figure 5:
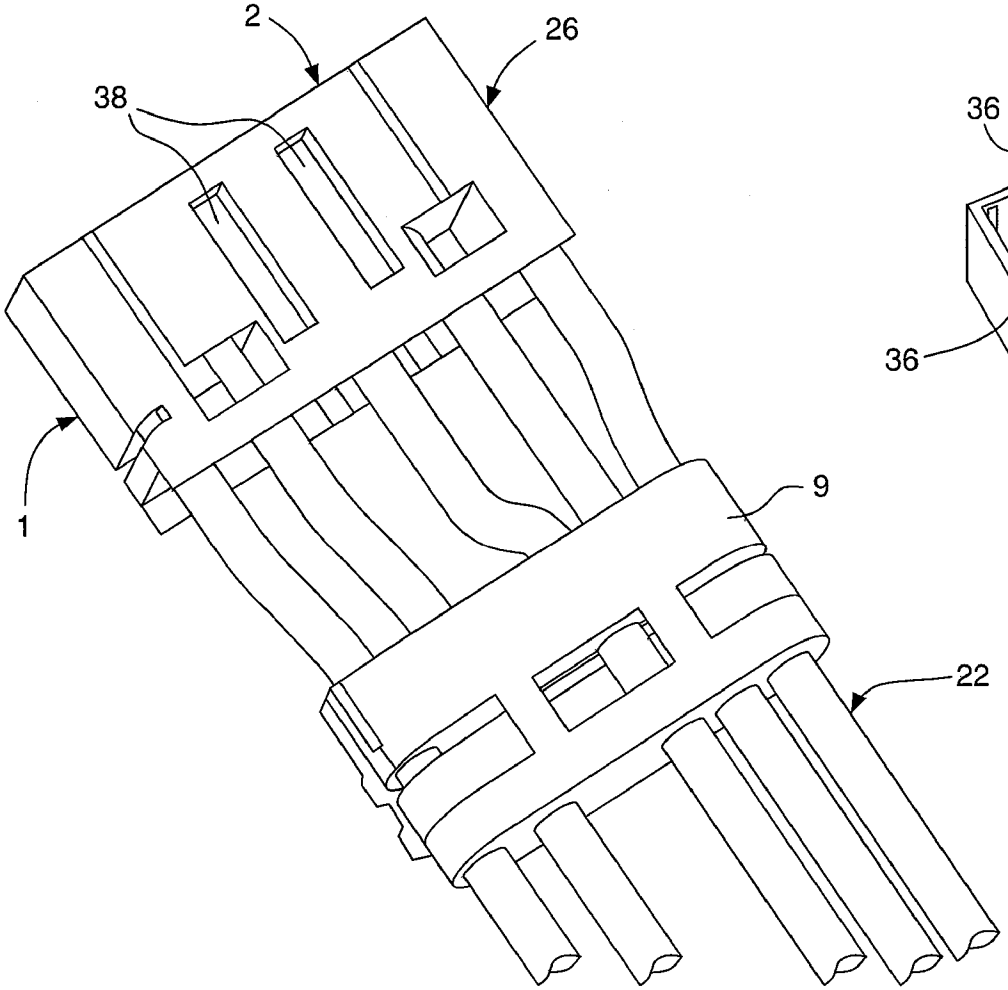
FIG. 5 is a perspective view of parts of the power cable connector of FIG. 1 according to a preferred embodiment of this invention.
Figure 8:
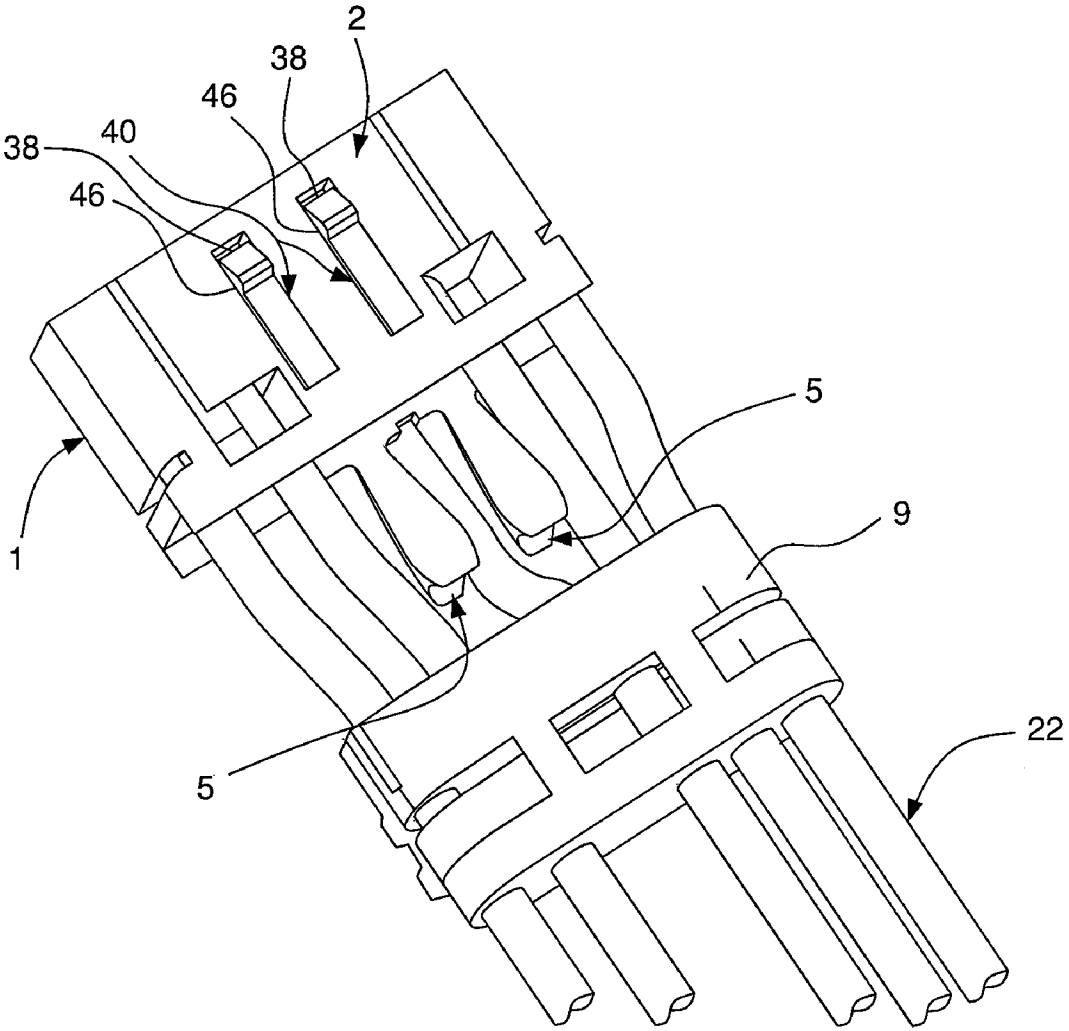
FIG. 8 is a perspective view of parts of the power cable connector of FIG. 1 according to a preferred embodiment of this invention.

The housing top portion 2 and the housing bottom portion 1 can each have slots 38 formed therein as shown in FIGS. 5-7. Each slot 38 receives an associated beam portion 40 of one of the latching springs 5, as is shown in FIG. 8, and is also understood with reference to FIGS. 3 and 13. Although FIG. 8 shows a top perspective showing the beam portions 40 of the latching springs disposed in the slots 38 of the top housing portion, it will be appreciated from FIGS. 3 and 5-7 that the beam portions of the latching springs are also disposed in the slots 38 of the housing bottom portion shown in FIG. 6.

Preferably, the latching springs 5 are located off-center of the centerline axis of the power cable connector, i.e., the latching springs 5 are located to the sides of the connector 20. Preferably, this arrangement facilitates a smaller form-factor and permits one of the power cables to be in-line with the centerline of the power connector when it mates with a quick disconnects, but off-center line through the strain relief member.

The cover top portion 4 has a tab 50, as shown in FIG. 10. Likewise, the cover bottom portion also has a similar tab. Although the cover bottom tab is not shown in FIG. 10, it will be appreciated that it is similar to the cover top tab. The tabs 50 are positioned over or under the latching springs 5. The tabs 50 can be used to release the latching springs 5 and therefore the power cable connector from a receptacle connector. This is accomplished by depressing the tabs 50 and thereby causing the spring beam portions 40 to move inwardly toward each other. As the spring beam portions 40 move toward each other, the lips 46 disengage from the associated slots 48 in the housing of the receptacle connector 25.

As shown in FIG. 3, the beam portions 40 of the springs each include a lip 46 proximate an end thereof. The lips 46 each become disposed in an associated slot 48 (shown in FIG. 2) in the housing of the receptacle connector 25 when the power cable connector 20 is mated with the receptacle connector 25. Contact between the lips 46 and the adjacent surfaces of the receptacle housing helps the power cable connector 20 and the receptacle connector 25 to remain in a mated condition.

The bottom portion 3 and the top portion 4 of the cover 28 each include a tab portion 50. As is best understood with reference to FIG. 3, the tab portions 50 are positioned over or under the latching springs 5, so that pressing or squeezing the tab portions 50 compresses the latching springs 5 and causes the beam portions 40 to move inwardly, toward each other, so as to cause the lips 46 to become disengaged from the associated slots 48 in the housing of the receptacle connector 25.

In operation, the power cable connector 20 is connected to a receptacle connector 25 as is best understood with reference to FIGS. 2 and 11. As the power cable connector 20 and the receptacle connector 25 are mated, the lips 46 of the latching springs are deflected and released into the slots 48 of the receptacle. Also, the receptacle contacts 24 are received into the housing slots 44 and mate with the quick disconnects 8 to form an electrical connection between the receptacle connector 25 and the power connector 20.

In order to release the power cable connector 20, the lips 46 are deflected downward to move the lips 46 out of the receptacle connector slots 48. Also, the power plug connector 20 is moved away from the receptacle connector 25 disconnecting the quick disconnects 8 from the receptacle contacts 24.

The inventive method of assembly of the preferred embodiment of this invention is now explained with reference to FIGS. 4-12. As shown in FIG. 4, the power cables 22 are passed through the passages in the strain relief member 9. The quick disconnects 8 are then preferably crimped onto the ends of the power cables 22. Following this, the quick disconnects 8 are disposed in the slots 30 in the housing bottom portion 1. The housing top portion 2 is then aligned with the housing bottom portion as best understood with reference to FIGS. 6 and 7. The members 34 of the top portion 2 are disposed in the mating holes 36 in the bottom portion. After the top portion 2 is attached to the bottom portion, the assembly state is shown in FIG. 5.

Figure 9:
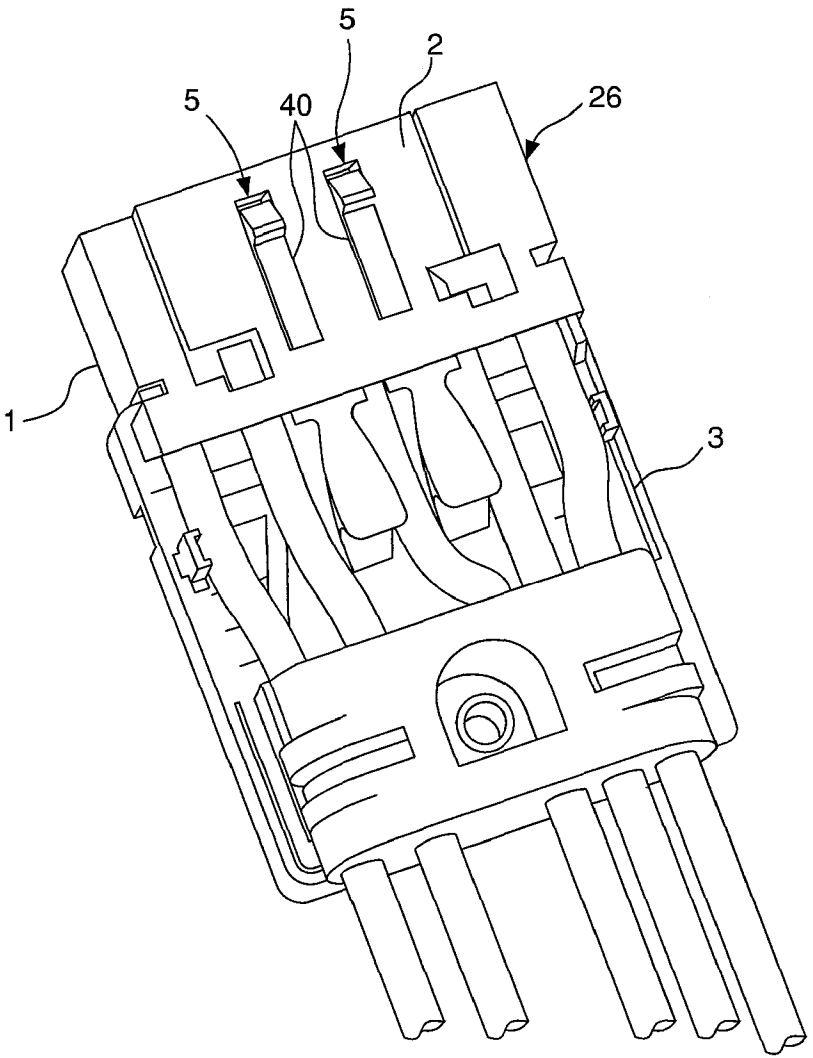
FIG. 9 is a perspective view of parts of the power cable connector of FIG. 1 according to a preferred embodiment of this invention.

The latching springs 5 are then attached by disposing the beam and lip portions in the housing slots as shown in FIG. 8. Next, the cover bottom portion 3 is placed underneath the strain relief member 9 as shown in FIG. 9. The cover top portion is then affixed to the cover bottom portion to cover the strain relief member 9 as shown in FIG. 10. This is preferably done by mechanically fastening the fastener 7 to the nut 8. FIG. 11 shows the connector 20 assembled according to a preferred embodiment of the invention.

Each contact 8 can be loaded into the associated slot 30 from above, from the perspective of FIGS. 4 and 6. Consequently, the method of this invention is preferably a top loading assembly method.

The connector 20 can be mated with the receptacle connector 25, such as that shown in FIG. 1 or 11, to form a connector system. It will be appreciated that the power plug connector 20 can be mated with a variety of receptacle connectors such as board connectors that are preferably either right-angle or straight connectors. Also, it will be appreciated that the connector 20 can be mated with a receptacle connector having any of a variety of receptacle contacts, and the power connector 20 and its quick disconnects 8 can be sized and shaped to received those receptacle contacts.

Figure 15:
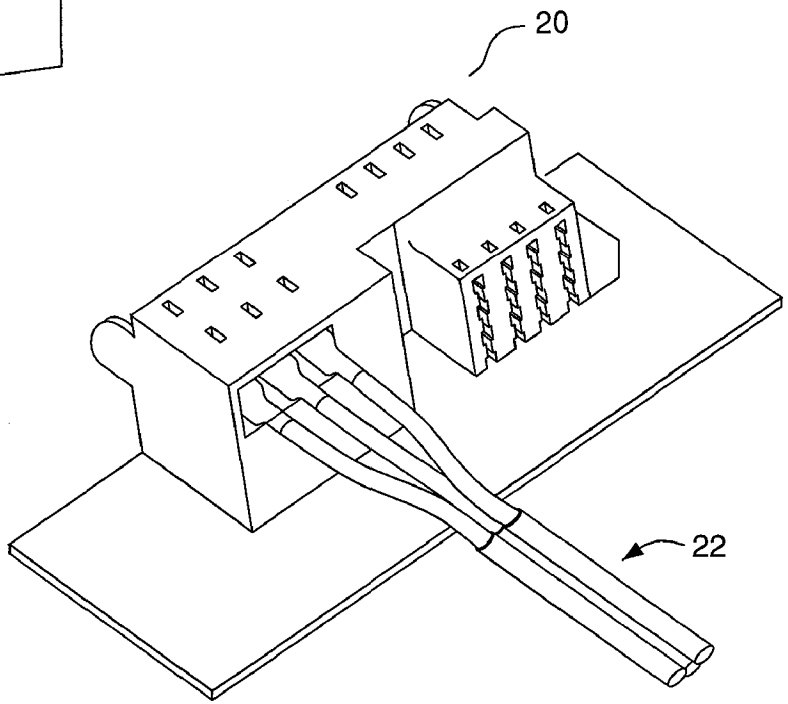
FIG. 15 is a perspective view of the embodiment of FIG. 14.
Figure 14:
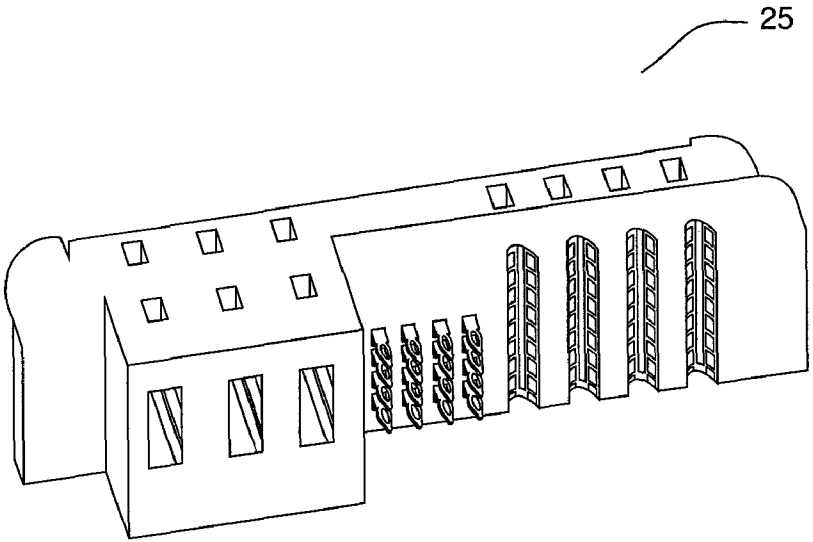
FIG. 14 is a perspective view of a second embodiment of a receptacle connector for mating with the power cable connector.

FIG. 14 is a front perspective view of a receptacle assembly 20 that the power contact of this invention can mate with, and FIG. 15 is back perspective view of this assembly. This embodiment has three power cables 22, and three corresponding contacts.

FIGS. 16A-16F depict three embodiments of a receptacle contact 24 with which the power plug contacts of this invention can mate. FIGS. 16A, 16C, and 16E are three different embodiments and these figures shown half of the contact. FIGS. 16B, 16D, and 16F depict both halves of the contact assemblies. In these embodiments, the receptacle contact has five pairs of beams 24*e* as shown in FIGS. 16B, 16D, and 16F. FIGS. 16A, 16C, and 16E are three different embodiments and these figures shown half of the contact. These halves each have a hole 24*h*. FIGS. 16B, 16D, and 16F depict both halves of the contact assemblies. As shown the other halves of the contact assemblies have a boss 24*i* that mates with the hole 24*h* to form the contact.

In these embodiments, the receptacle contact has five pairs of beams 24*e* as shown in FIGS. 16B, 16D, and 16F. Preferably, the pairs of contact beams are alternating between parallel contact beams 24*j* and shaped contact beams 24*k*. The shaped contact beams 24*k* preferably extend outward from each other, then inward toward each other, and then away from each other as shown in FIGS. 16B, 16D, and 16F. Although an embodiment of the quick disconnects is shown for the power plug connector, it will be appreciated that the power plug quick disconnects can be similar and corresponding to the receptacle contacts so that they can mate with the receptacle contacts. For example, the power plug quick disconnects may have fives pairs of contact beams that alternate in a pattern opposite to the receptacle contacts.

Also, each receptacle contact of FIGS. 16A, 16B, and 16C has a different contact portion dependent upon the specific application. In the embodiment of FIGS. 16A and 16B, the contact portion 24*a* comprises parallel beams that mate with each other by having one of the beams having a hole 24*f* and the other having a boss 24*g* that mates with the hole 24*f* as shown. Alternatively, the receptacle contacts can have flexible contact portions 24*c*, and 24*d* as shown in FIG. 16D. These contact portions 24*c*, 24*d* are preferably flexible and have ends that are bent in an alternating fashion as shown. In a third preferred embodiment, the contact portions 24*d*, 24*l* as shown in FIG. 16F are disposed in a stacked arrangement and are parallel to each other.

Figure 20:
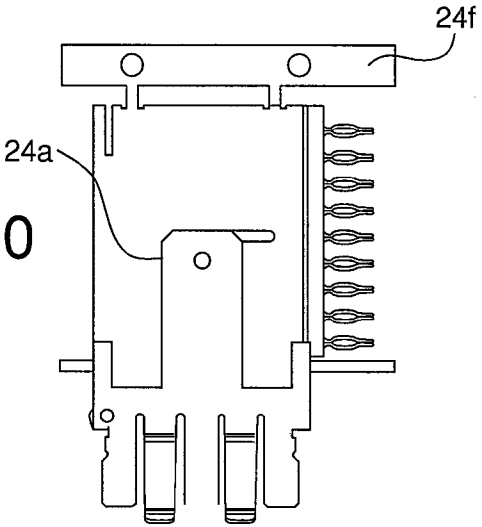
FIG. 20 is a side view of a preferred embodiment of a blade contact of a receptacle connector for mating with the power cable connector according to a preferred embodiment of this invention according to FIG. 16A.
Figure 21:
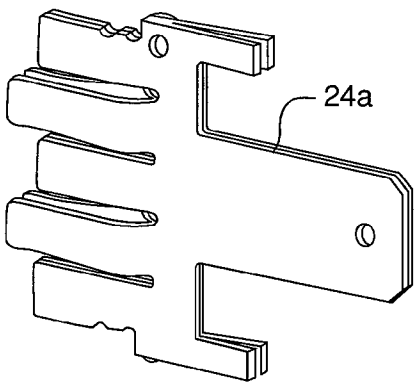
FIG. 21 is a perspective view of the preferred embodiment of FIG. 16B.
Figure 17:
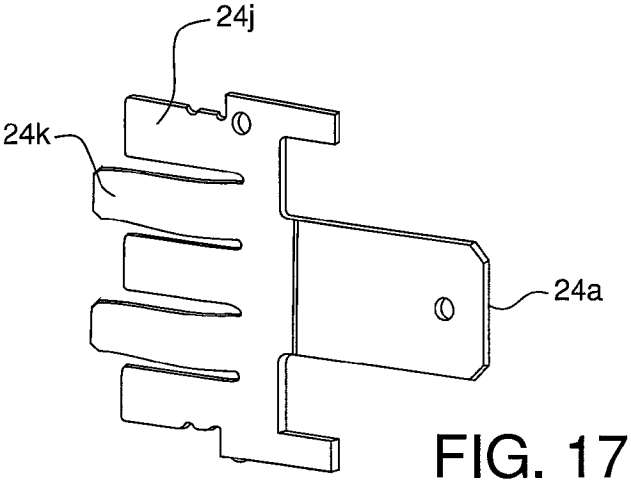
FIG. 17 is a perspective view of the embodiment of FIG. 16A.
Figure 18:
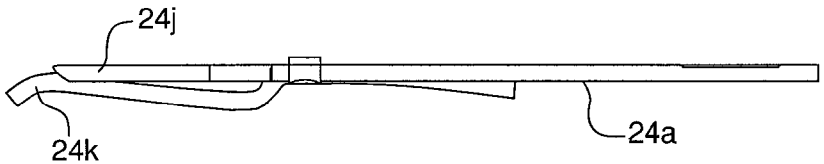
FIG. 18 is a top view of the preferred embodiment of FIG. 17.
Figure 19:
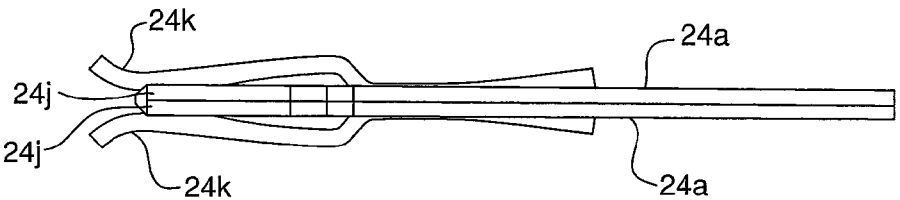
FIG. 19 is a top view of the preferred embodiment FIG. 16B.
Figure 29:
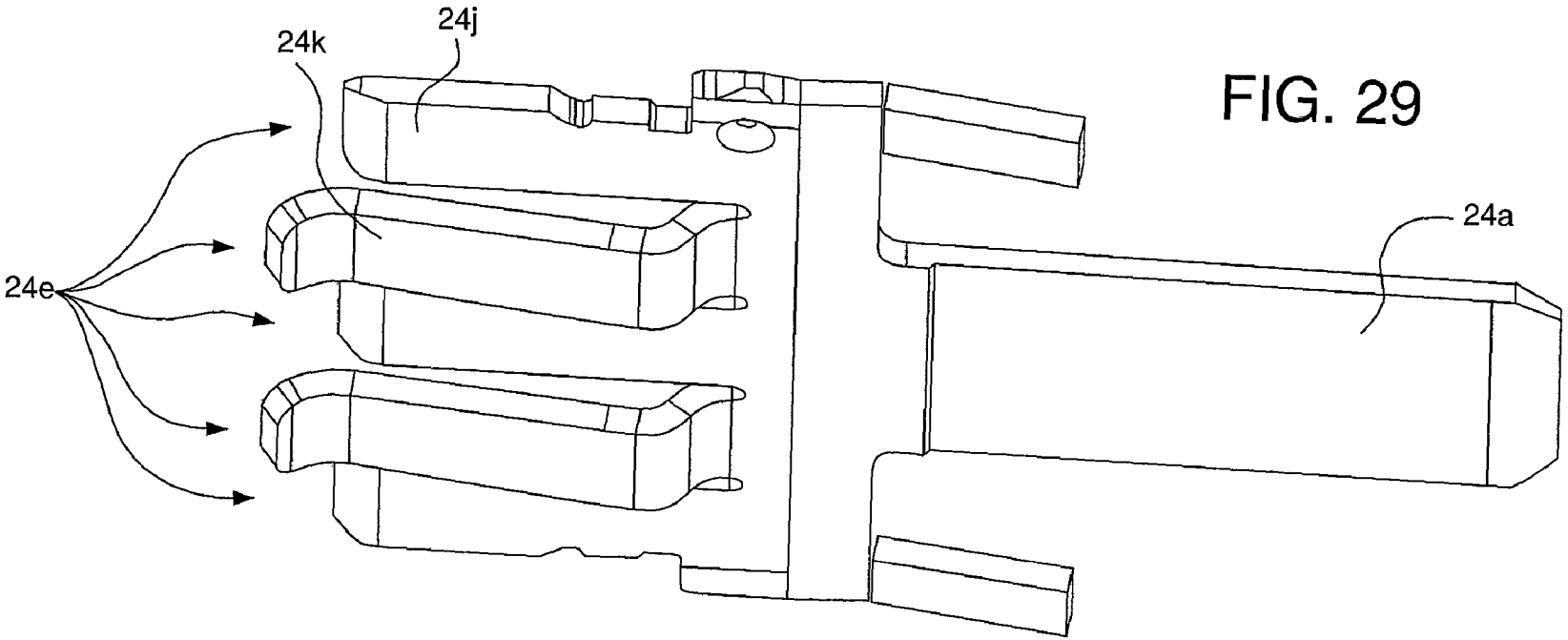
FIG. 29 is a perspective view of a preferred embodiment of FIG. 16B.
Figure 30:
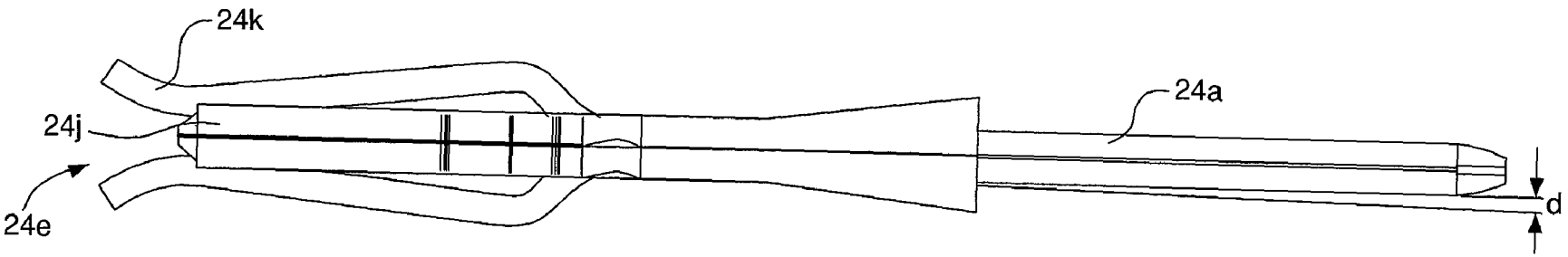
FIG. 30 is a top view of the preferred embodiment of FIG. 29.
Figure 32:
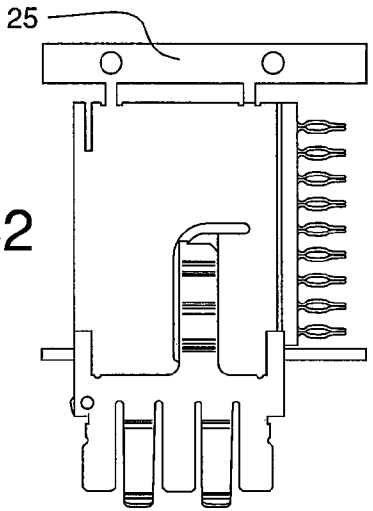
FIG. 32 is a side view of the preferred embodiment of FIG. 16C mounted to a strip.
Figure 35:
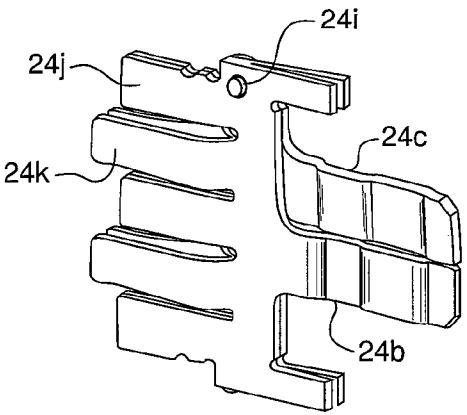
FIG. 35 is a perspective view of the preferred embodiment of FIG. 34.
Figure 31:
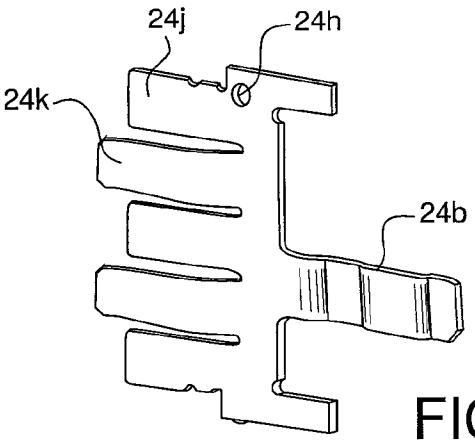
FIG. 31 is a perspective view of the preferred embodiment of FIG. 16C.
Figure 33:
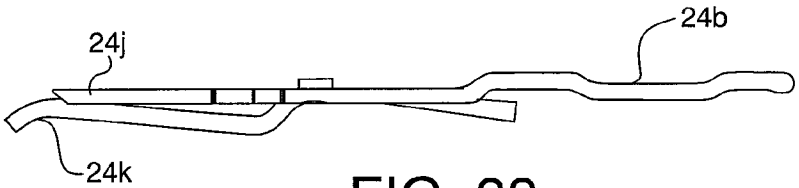
FIG. 33 is a top view of the preferred embodiment of FIG. 31.
Figure 34:
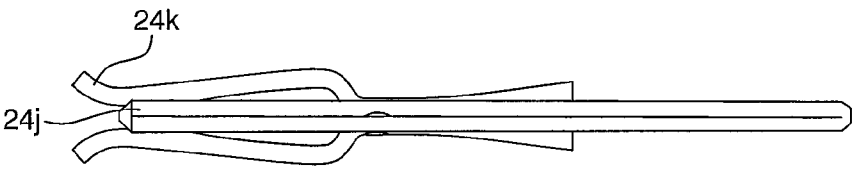
FIG. 34 is a top view of the preferred embodiment of FIG. 16D.
Figure 39:
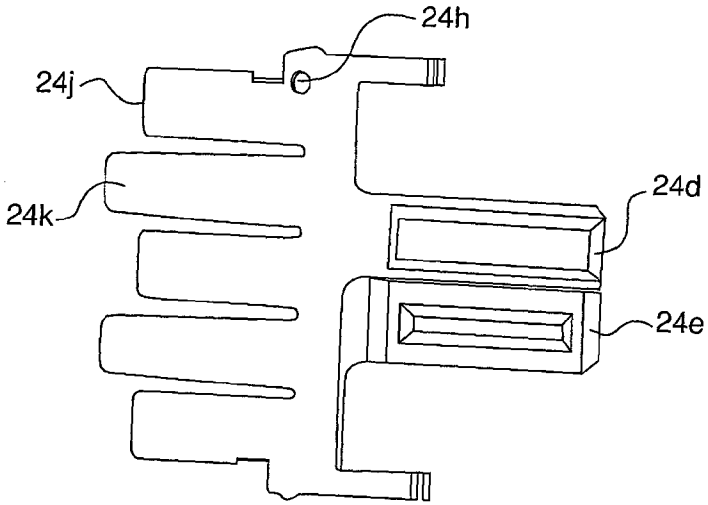
FIG. 39 is a side of the preferred embodiment of FIG. 38.
Figure 36:
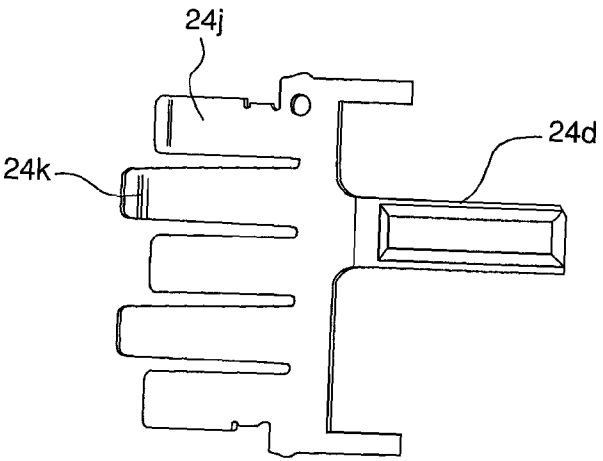
FIG. 36 is a side view of the preferred embodiment of FIG. 16E.
Figure 37:
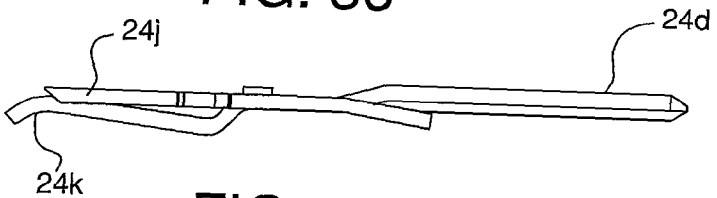
FIG. 37 is a top view of the preferred embodiment of FIG. 16E.
Figure 38:
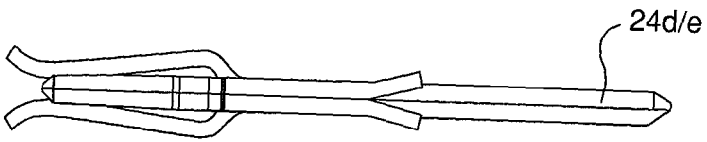
FIG. 38 is a top view of the preferred embodiment of FIG. 16F.

FIGS. 17-21 are additional drawings of the embodiment of FIG. 16A. FIG. 18 is a top view of the half of the assembly of FIG. 17, and FIG. 19 is a top view of the entire receptacle contact. FIG. 19 also shows the alternating contact beams 24*j*, 24*k*. FIG. 20 depicts half of the contact assembly of FIG. 17 during manufacturing with a carrier 24*f* attached. FIG. 29 is a perspective view of the contact assembly of FIG. 16B, and FIG. 30 is another top view of this assembly. As shown in FIG. 30, the contact portion 24 a may be have an angle so that it is offset by a distance d. This facilitates mating with a receptacle.

It will be appreciated that any number of conventional manufacturing processes can be used to form contacts for use with the power plug connector and a mating receptacle according to a preferred embodiment of this invention. FIGS. 22-28 show the part of the manufacturing process for one of the preferred embodiments shown. FIG. 22 shows a pair of mating contact halves. On the left is the embodiment of FIG. 16A that has a hole mating 24*h*, and on the right is a contact half with a mating boss 24*i*. FIG. 22 shows the two contact halves held by a contact carrier 25. FIGS. 23 and 24 shown the contact halves of FIG. 22 being mated together as shown with the contact carrier 25 attached. FIGS. 25 and 26 depict the contacts being punched or stamped to form the mating holes 24*h* and FIGS. 27 and 28 depict the contact pairs separated during the manufacturing process. These processes are shown for illustrative purposes and other processes can be used.

FIGS. 31-35 are additional views of the receptacle contact assembly of FIGS. 16C and 16D. FIGS. 36-39 are additional views of the receptacle contact assembly of FIGS. 36-39.

FIGS. 14-39 depict various receptacle contacts with which the contacts 8 of the power cable connector 20 can be mated. The blade or blades of these power contacts are denoted in the figures by the numerical reference character 24, followed by an alphabetical character. The power contacts can include various combinations of straight and angled contact beams as disclosed in U.S. application Ser. No. 11/408,437, the contents of which is incorporated by reference herein in its entirety. Power contacts having blades with which the contacts 8 of the connector 20 can be mated are also disclosed in U.S. application Ser. No. 11/054,206, the contents of which is incorporated by reference herein in its entirety.

The foregoing description is provided for the purpose of explanation and is not to be construed as limiting the invention. While the invention has been described with reference to preferred embodiments or preferred methods, it is understood that the words which have been used herein are words of description and illustration, rather than words of limitation. Furthermore, although the invention has been described herein with reference to particular structure, methods, and embodiments, the invention is not intended to be limited to the particulars disclosed herein, as the invention extends to all structures, methods and uses that are within the scope of the appended claims. Those skilled in the relevant art, having the benefit of the teachings of this specification, may effect numerous modifications to the invention as described herein, and changes may be made without departing from the scope and spirit of the invention as defined by the appended claims.

What is claimed:

1. A power cable connector, comprising:

a housing comprising a top, a bottom mated to the top, a first plurality of slots disposed in the top and the bottom, and a second plurality of slots disposed in the housing, each of the second plurality of slots including a first slot portion having a first width and a second slot portion having a second width that is less than the first width;

a plurality of latches configured to mate the power cable connector with a mating connector, each latch comprising a lip extending through one of the first plurality of slots;

a plurality of quick disconnect contacts, each quick disconnect contact supported in the housing and disposed in a corresponding one of the second plurality of slots;

a cover, coupled to the housing;

a strain relief member disposed within the cover and comprising a plurality of passages; and a plurality of cables, each cable being connected to one of the quick disconnect contacts and extending through one of the strain relief member passages.

2. The power cable connector of claim 1, wherein the housing top portion comprises projections that are disposed in holes disposed in the housing bottom portion.

3. The power cable connector of claim 1, wherein the cover comprises a top cover and a bottom cover that are mated together.

4. The power cable connector of claim 3, flirt her comprising a fastener that assembles the top cover to the bottom cover.

5. The power cable connector of claim 1, wherein the latches comprise springs.

6. The power cable connector of claim 1, wherein the plurality of latches comprise beams that are coupled to the latch lips that are for mating with a receptacle connector.

7. The power cable connector of claim 6, wherein the cover comprises flexible tabs and the latch beams are disposed at least partially proximal to the cover tabs so that the cover tabs can be depressed to deflect the latch beams and thereby release the connector from the mating connector.

8. The power cable connector of claim 6, wherein the power cable connectors are disposed off the connector centerline and one of the quick disconnect contacts is mounted along the centerline of the power cable connector.

9. The power cable connector of claim 1, further comprising a mating connector, wherein each quick disconnect contact engages a mating contact of the mating connector, the mating contact comprising parallel contact beams, shaped contact beams, and a contact portion that mates with the quick disconnect contact.

10. The power cable connector of claim 9, wherein the contact portion is flexible.

11. The power cable connector of claim 1, wherein each quick disconnect contact engages a single mating contact of the mating connector.

12. A power connector system, comprising:

a plug connector, comprising:

a plug housing comprising a top, a bottom, a first plurality of slots disposed in the top and the bottom;

a plurality of latches that each comprises a lip extending through one of the first plurality of slots, the latches configured to mate the connector with a mating connector;

a plurality of contacts, each contact being disposed in a corresponding one of a second plurality of slots formed in the housing;

a cover, coupled to the housing;

a strain relief member disposed within the cover and comprising a plurality of passages;

a plurality of cables, each cable being connected to one of the contacts and extending through one of the strain relief member passages, wherein the plug connector defines first and second lateral sides separated by a central axis, an odd number of the cables is disposed on the first lateral side, and an even number of the cables is disposed on the second lateral side; and wherein the plug connector is configured to mate with a receptacle connector, comprising:

a receptacle housing comprising a plurality of holes through which the latch lips can extend when the plug connector is mated to the receptacle connector;

the receptacle housing is larger than the plug housing and is for extending into the receptacle housing when the plug and receptacle connectors are mated;

a plurality of receptacle contacts, disposed in the receptacle housing, that are for extending into the plug housing and mating with the contacts.

13. The power connector system of claim 12, wherein the plug housing further comprises a tab, connected to the housing and disposed proximal to the latches, that is for depressing to move the latch lip out from the receptacle holes to release the plug connector from the receptacle connector.

14. The power connector system of claim 12, wherein the plug housing top portion comprises projections that are disposed in holes disposed in the housing bottom portion.

15. The power connector system of claim 12, wherein the cover comprises a top cover and a bottom cover that are mated together.

16. The power connector system of claim 15, further comprising a fastener that assembles the top cover to the bottom cover.

17. The power connector system of claim 12, wherein the receptacle contacts comprise at least one pair of parallel beams and at least one pair of beams, each beam having first portions that extend outward from each other, and second portions that extend inward toward each other.

18. The power connector system of claim 12, wherein the latches comprise springs.

19. The power connector system of claim 12, wherein the plurality of latches comprise beams that are coupled to the latch lips.

20. The power connector system of claim 19, wherein the cover comprises flexible tabs and the latch beams are disposed at least partially proximal to the cover tabs so that the cover tabs can be depressed to deflect the latch beams and thereby release the connector from the mating connector.

21. The power connector system of claim 12, wherein each contact engages a single one of the receptacle contacts.

22. The power connector system of claim 21, wherein each of the receptacle contacts comprises parallel contact beams, shaped contact beams, and a contact portion that mates with one of the plurality of contacts.

23. The power cable connector of claim 22, wherein the contact portion is flexible.

24. The power cable connector of claim 12, wherein each contact includes a vertical wall extending between the top and bottom of the housing, and a pair of horizontal walls extending from top and bottom ends of the vertical wall, each horizontal wall terminating at a free distal end.

25. The power connector system of claim 12, wherein each contact comprises a vertical wall extending between the top and bottom of the housing, and the vertical wall is configured to engage the single mating contact.

26. The power connector system of claim 12 wherein the latches define an opening therebetween, and a select cable of the plurality of cables extends through one of the passages of the strain relief member, and through the opening between the latches, and connects to one of the quick disconnect contacts.

27. The power connector system of claim 26, wherein the opening between the latches is laterally offset with respect to said one of the passages of the strain relief member.

28. The power connector system of claim 27, wherein the latches are connected to each other.

29. A method of assembling a power cable connector, the method comprising the steps of:

providing a housing;

providing a cover that has a cover bottom and a cover top;

attaching each of a plurality of power cables to a corresponding quick disconnect contact among a plurality of quick disconnect contacts;

placing each of the quick disconnect contacts into a one of a first plurality of slots disposed in the housing;

attaching a pair of latch springs to the housing by disposing lips of the latch spring in one of a second plurality of slots disposed in the housing such that the latch springs define an opening therebetween;

inserting a select power cable of the plurality of power cables through a passage of a strain relief member, through the opening between the latch springs, and connecting the select power cable to the corresponding quick disconnect contact; and assembling the cover bottom to the cover top around the strain relief member, such that the cover is disposed over at least part of the latches.

30. The method of assembling of claim 29, wherein the step of attaching comprises crimping the quick disconnects onto the power cables.

31. The method of assembling of claim 29, wherein the first plurality of housing slots is disposed in housing bottom portion and the method further comprises attaching a housing top portion to the housing bottom portion.

32. The method of claim 29, wherein the latch springs are joined together.

33. The method of claim 29, wherein the providing steps further comprise providing the housing and the cover separately such that the housing and the cover are not integrally connected.

* * * * *